US006517192B2

(12) United States Patent
Kaneko et al.

(10) Patent No.: US 6,517,192 B2
(45) Date of Patent: Feb. 11, 2003

(54) IMAGE FORMING APPARATUS AND METHOD

(75) Inventors: Takumi Kaneko, Tokyo (JP); Toshiharu Inui, Kanagawa (JP); Daigoro Kanematsu, Kanagawa (JP); Hidehiko Kanda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/078,345

(22) Filed: Feb. 21, 2002

(65) Prior Publication Data

US 2002/0158942 A1 Oct. 31, 2002

(30) Foreign Application Priority Data

Feb. 23, 2001 (JP) ..... 2001-049006

(51) Int. Cl.[7] ..... B41J 2/21
(52) U.S. Cl. ..... 347/43; 347/14; 347/15
(58) Field of Search ..... 347/43, 15, 14, 347/16, 41

(56) References Cited

U.S. PATENT DOCUMENTS 4,533,928 A 8/1985 Sugiura et al. ..... 347/43
5,717,448 A * 2/1998 Inada ..... 347/14
6,050,680 A * 4/2000 Moriyama et al. ..... 347/14
6,086,185 A 7/2000 Inui et al. ..... 347/43
6,102,537 A 8/2000 Kato et al. ..... 347/101
6,142,598 A 11/2000 Iwasaki et al. ..... 347/9
6,142,604 A 11/2000 Kanada et al. ..... 347/41
6,267,476 B1 7/2001 Kato et al. ..... 347/100
6,378,982 B2 4/2002 Ono et al. ..... 347/41

FOREIGN PATENT DOCUMENTS

JP 3054508 4/2000

* cited by examiner

*Primary Examiner*—Lamson Nguyen
(74) *Attorney, Agent, or Firm*—Fitzpatrick, Cella, Harper & Scinto

(57) ABSTRACT

Disclosed is an inkjet printing apparatus for forming an image by repeatedly causing the scanning of a printhead that prints an image in a scan area using inks of a plurality of types. Residual duty, which is obtained by quantifying the mixed state of the inks used in printing the image in the scan area, is defined. The residual duty with regard to the next scan area is found from image data, the scanning direction for printing in the next scan area is decided based upon the residual duty, and the area is printed in the scanning direction that has been decided. Thus, back-and-forth scanning and unidirectional scanning are used jointly in appropriate fashion in accordance with the printed image. As a result, high-quality printing of an image becomes possible and a higher printing speed is achieved.

35 Claims, 19 Drawing Sheets

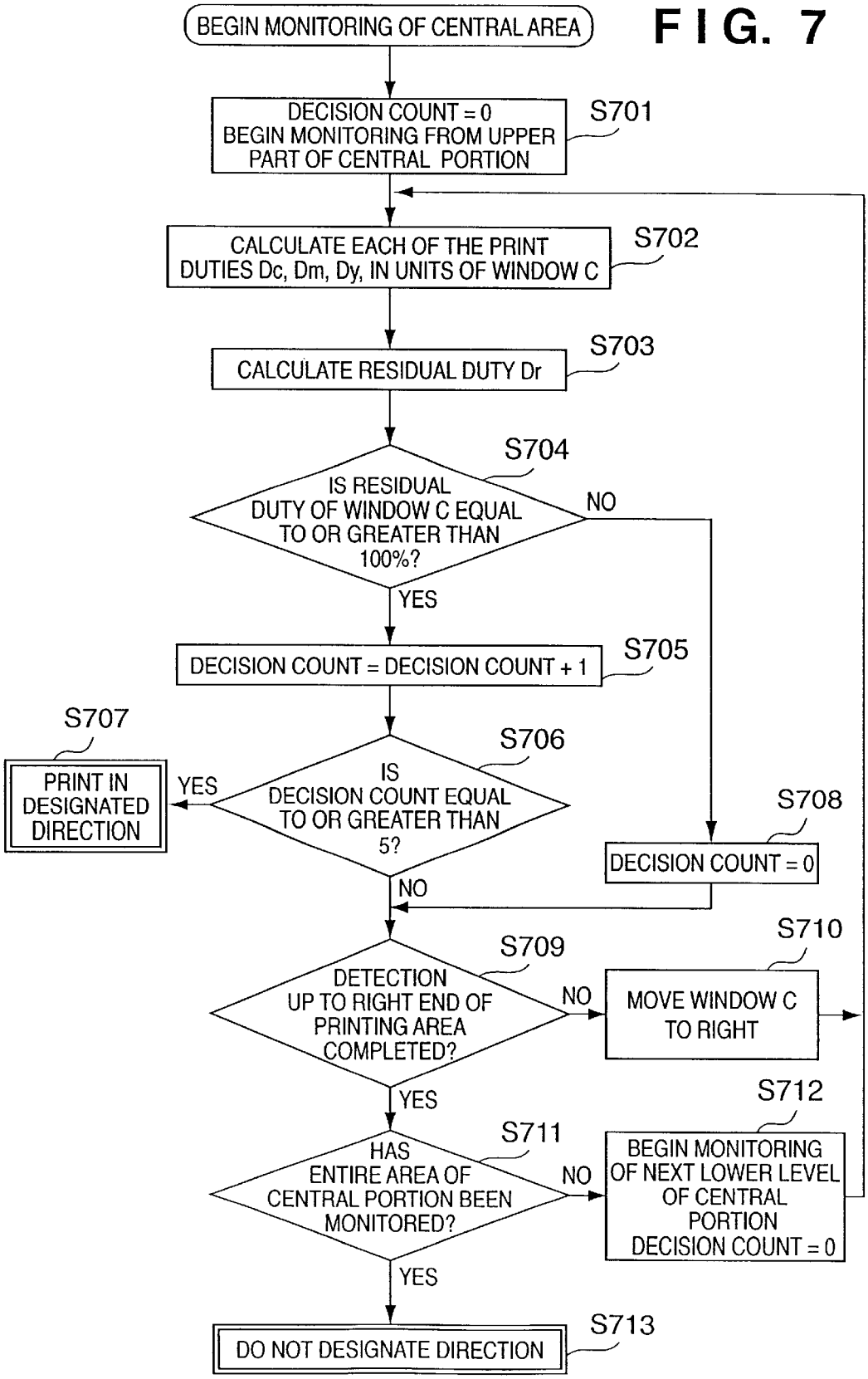
FIG. 7
BEGIN MONITORING OF CENTRAL AREA
DECISION COUNT = 0
BEGIN MONITORING FROM UPPER PART OF CENTRAL PORTION
S701
CALCULATE EACH OF THE PRINT DUTIES Dc, Dm, Dy, IN UNITS OF WINDOW C
S702
CALCULATE RESIDUAL DUTY Dr
S703
S704
IS RESIDUAL DUTY OF WINDOW C EQUAL TO OR GREATER THAN 100%?
NO
YES
DECISION COUNT = DECISION COUNT + 1
S705
S707
PRINT IN DESIGNATED DIRECTION
YES
S706
IS DECISION COUNT EQUAL TO OR GREATER THAN 5?
S708
DECISION COUNT = 0
NO
S710
S709
DETECTION UP TO RIGHT END OF PRINTING AREA COMPLETED?
NO
MOVE WINDOW C TO RIGHT
YES
S712
S711
HAS ENTIRE AREA OF CENTRAL PORTION BEEN MONITORED?
NO
BEGIN MONITORING OF NEXT LOWER LEVEL OF CENTRAL PORTION DECISION COUNT = 0
YES
S713
DO NOT DESIGNATE DIRECTION

IMAGE FORMING APPARATUS AND METHOD

FIELD OF THE INVENTION

This invention relates to an image forming method and apparatus for forming an image by ejecting a printing fluid such as ink onto a printing medium while causing printing means to scan a printing medium.

BACKGROUND OF THE INVENTION

The inkjet printing method, which allows printing to be performed on a variety of printing media, makes possible high-density, high-speed printing. For this reason, the method has been applied to full-size printers and portable printers used to produce the output of various devices, and such printers have appeared as commercial products. Each individual printer is adapted to support the functions and mode of use specific to the particular device.

In general, an inkjet printer is equipped with a carriage on which printing means (a printhead) and an ink tank are mounted, transport means for transporting the printing medium, and control means for controlling these components. The printhead, which ejects ink droplets from a plurality of orifices, is caused to perform serially scanning in a direction (referred to as the "main-scan direction") at right angles to the direction (referred to as the "sub-scan direction") in which the printing paper is transported. When printing is not being performed, the printing medium is transported intermittently in increments equivalent to printing width. This printing method is such that printing is carried out by ejecting ink onto the printing paper in accordance with a print signal. The method is in widespread use owing to its low running cost and quietness. In recent years a large number of products in which this method is applied to color printers using multiple color inks have come into practical use.

Color printers to which the inkjet printing method is applied have printheads whose structures can be broadly classified into two different types.

The first type is a printhead in which a large number of nozzles for ejecting ink are placed on a straight line extending in the sub-scan direction, as shown in FIG. 15. Here a printhead 100 has nozzles 100*y*, 100*m*, 100*c*, 100*k* for ejecting yellow, magenta, cyan and black ink, respectively, arranged in a single row in the sub-scan direction in such a manner that colors will not overlap. FIG. 16 illustrates an arrangement if a printhead 101 in which the nozzle 101*k* for ejecting black ink is disposed separate from the nozzles 101*y*, 101*m*, 101*c* that eject color ink. It should be obvious from FIGS. 15 and 16 that images in the colors yellow, magenta and cyan are formed at different positions on the printing paper in a single main scan of the printhead. If so-called secondary colors of blue, red and green are formed, therefore, the sequence in which colors are superimposed is fixed irrespective of the direction in which the printhead is scanned. For example, if a blue image is formed, first cyan is printed and then magenta is printed so as to overlap cyan. Accordingly, if the printhead 100 or 101 is used, unevenness in color will not occur even when printing by back-and-forth scanning of printhead is performed.

However, if the number of nozzles of each color is increased in order to raise printing speed, the length of the printhead is enlarged, resulting in an apparatus of greater size. There is also a tendency toward greater complexity in terms of retaining the printing medium in the printing area of the printhead, thereby inviting an increase in the cost of the printhead and apparatus. Accordingly, a printhead of a second type, described below, has come into use.

As shown in FIG. 17 by way of example, a printhead 102 of the second type has printheads 102*k*, 102*c*, 102*m*, 102*y*, which eject black, cyan, magenta and yellow ink, respectively, arrayed in the main-scan direction. If the printhead 102 is used, the inks of all colors are ejected by a single scan in accordance with image data.

When an image is formed by alternately repeating a scan in the left-to-right direction (the direction indicated by arrow A in the drawings) and in the right-to-left direction (the direction indicated by arrow B) in order to raise printing speed, the sequence in which the colors are superimposed in the scanning of printhead 102 in the A direction differs from that of the B direction if a secondary color of blue, red or green, for example, is formed. As a consequence, the hue differs in each scan and color unevenness results, causing a major decline in image quality.

A multiple-pass printing method the purpose of which is to improve image quality is available. This method causes printing to be performed at the same location by two or more scans, thereby mitigating nozzle-to-nozzle variance peculiar to a printhead. In this case, the distance traveled by the printing medium each time it is transported is half the length of the head. Printing time can be reduced by using back-and-forth printing also when forming an image by this method. However, when a secondary color is formed, color unevenness caused by a difference in the sequence of color overlap occurs even with this printing method.

As mentioned above, there are two types of structures for inkjet printheads applied to a color printing apparatus. However, the type that can be said to be suited to raising the speed of printing of the apparatus is the second type, namely the type in which the nozzles of each color are arranged in the scanning direction of the printhead. In-the case of the second type, however, a problem which arises is the scan-to-scan color unevenness caused by a difference in which colors overlap in the scanning of the printhead in the back and forth directions, as mentioned above.

In order to solve this problem, a method of &U changing the method of color processing so that one method is used when the printhead is scanned in the left-to-right direction and another method when the printhead is scanned in the right-to-left direction has been disclosed in the specification of Japanese Patent Publication No. 3-54508. However, this method requires two types of color processing tables for the respective scanning directions.

In a case where printing is performed by an ordinary printer, color processing is executed by a printer driver operating in a host computer and image data that has undergone color processing is sent to the printer proper. The printer performs printing by manipulating and processing the received image data in conformity with the printhead. However, when color processing is executed in the arrangement described in the above-mentioned specification, it is necessary to ascertain beforehand how the image data being processed will be printing on the printer side. For example, if color processing is changed between left-to-right and right-to-left directions when printing is carried out by back-and-forth scanning, the host computer side must recognize whether the printhead will print by a scan in the left-to-right direction or by a scan in the right-to-left direction. However, this results in a very highly complicated system, inclusive of the printer driver and printer proper.

Furthermore, the color reproduction ranges (hues) of the scans in the left-to-right and right-to-left directions usually deviate from each other. This means that if the color processing is changed so as to achieve a common color reproduction range for both of the scanning directions, the color reproduction range will become narrower and may bring about a decline in image quality.

SUMMARY OF THE INVENTION

Accordingly, an object of the present invention is to prevent a decline in image quality caused by a difference in coloring sequence between back and forth scans, thereby making it possible to achieve high-quality printing of an image.

Another object of the present invention is to address the problem of color unevenness due to a difference in color ejection sequence caused by performing back-and-forth printing using a printhead in which the nozzles of each color are arranged in the direction of scanning, and the problem of a decline in printing speed caused by performing printing in one direction only, thereby to make possible an improvement in printing speed while reducing color unevenness even in a color printing apparatus in which the sequence of ink ejection differs between back-and-forth scans.

According to the present invention, the foregoing objects are obtained by providing an image by repeatedly causing a printhead, which prints an image, to print on and scan a scan area using printing materials of a plurality of types, comprising: acquisition means for quantifying the state of a mixture of the printing materials in printing of an image in the next scan area, thereby acquiring index information representing the state of the mixture; decision means for deciding direction of a printing scan in to the next scan area based upon the index information acquired by the acquisition means; and print execution means for executing a printing scan in the next scan area by performing a printing scan in the direction decided by the decision means.

Further, according to the present invention, the foregoing objects are attained by providing an image forming method of forming an image by repeatedly causing a printhead, which prints an image, to print on and scan a scan area using printing materials of a plurality of types, comprising: an acquisition step of quantifying the state of a mixture of the printing materials in printing of an image in the next scan area, thereby acquiring index information representing the state of the mixture; a decision step of deciding direction of a printing scan in to the next scan area based upon the index information acquired at the acquisition step; and a print execution step of executing a printing scan in the next scan area by performing a printing scan in the direction decided at the decision step.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 7 is a flowchart useful in describing processing for deciding scanning direction in the first embodiment;

DETAILED DESCRIPTION OF THE PREFERRED EMBODIMENTS

Preferred embodiments of the present invention will now be described in detail in accordance with the accompanying drawings.

<First Embodiment (Single-pass Printing)>

A first embodiment of the present invention will be described with regard to a control procedure, and an apparatus for implementing the procedure, for improving image quality in back-and-forth scanning of single-pass printing.

Figure 1A:
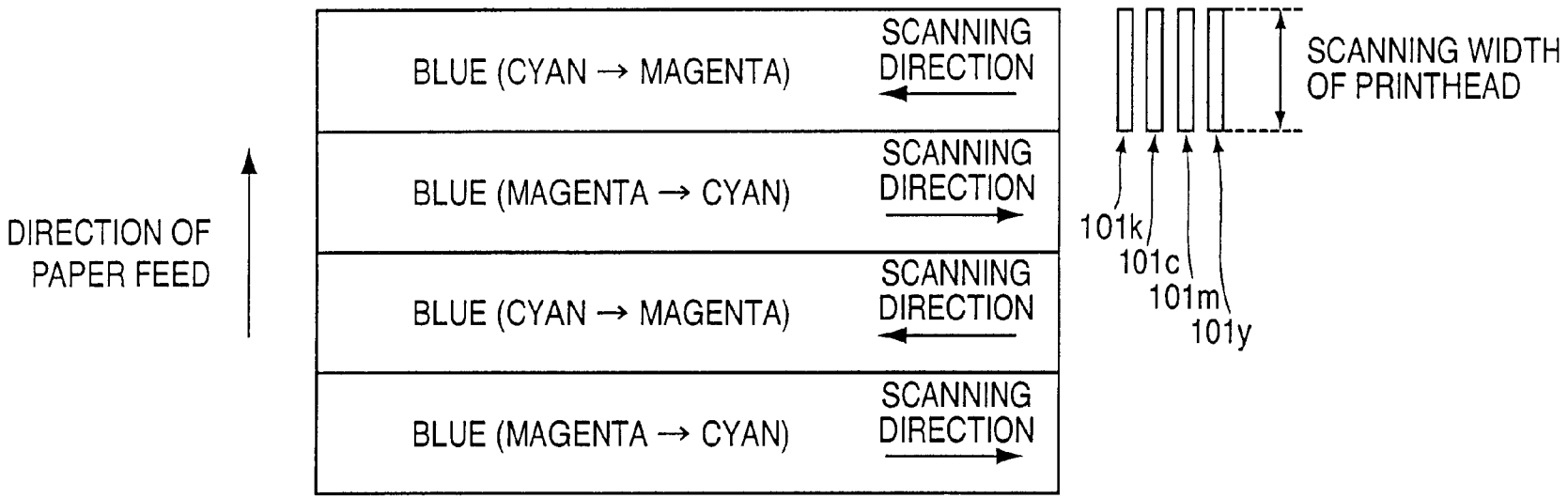
FIG. 1A is a diagram useful in describing color unevenness when an image is printed by back-and-forth scanning.
Figure 1B:
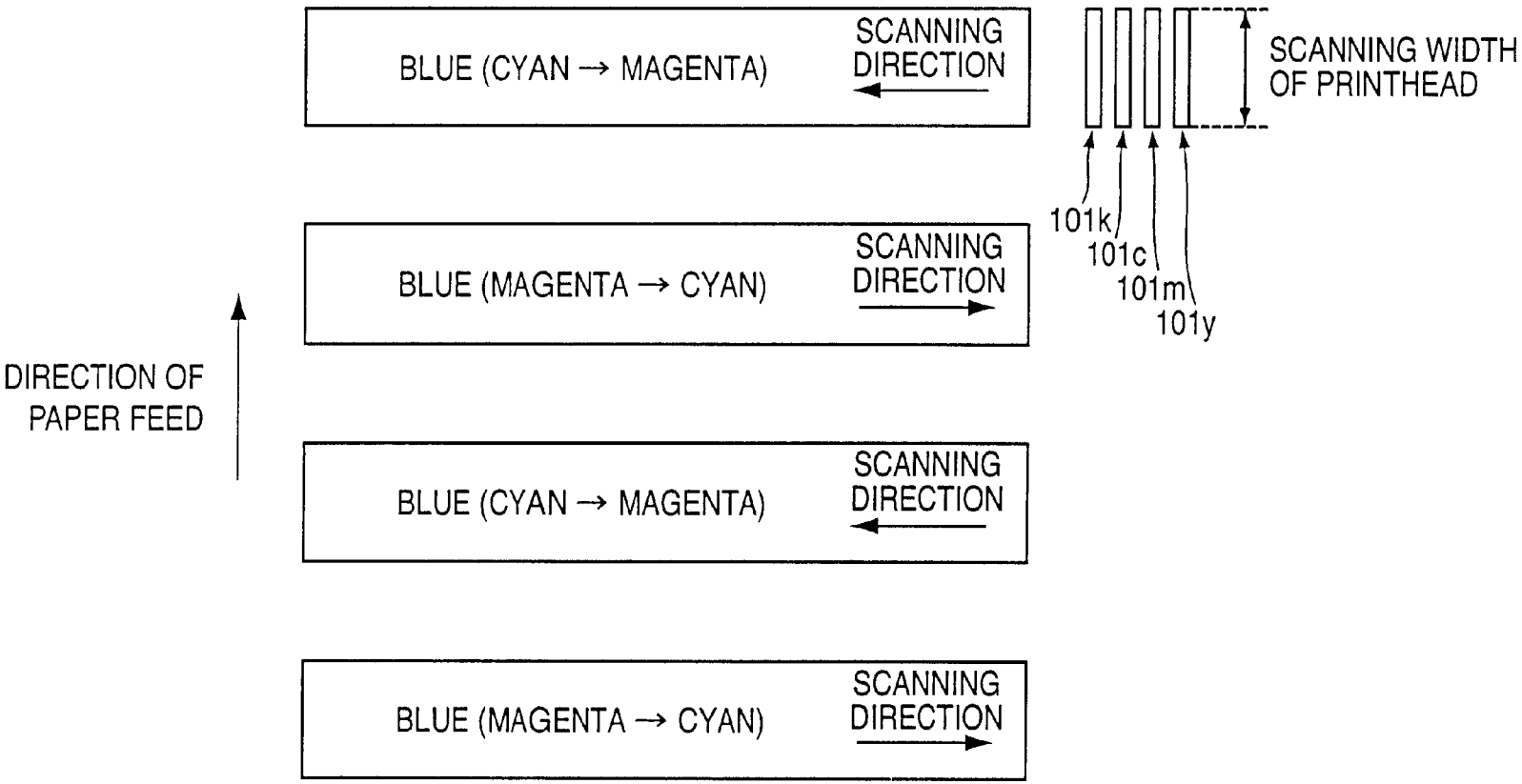
FIG. 1B is a diagram useful in describing color unevenness when printing of an image of an area smaller than the printing width of a printhead is performed by back-and-forth scanning.
Figure 1C:
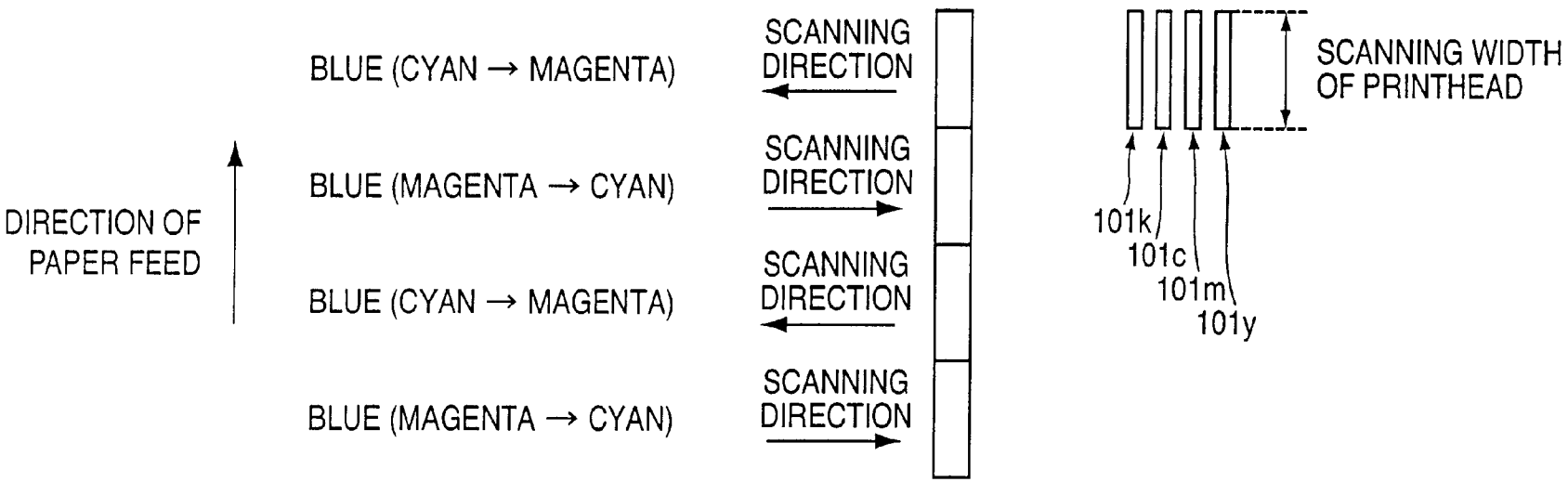
FIG. 1C is a diagram useful in describing color unevenness when printing of an image of an area that is narrow in the scanning direction is performed by back-and-forth scanning.

FIGS. 1A to 1C are for describing an example in which a filled image of the secondary color blue is printed by a printhead in which the nozzles are arrayed in the scanning direction to eject black ink, cyan ink, magenta ink and yellow ink.

FIG. 1A is a diagram showing an example in which a blue image in an area broader than the width of a single scan of a printhead is printed. In the prior art, unevenness in color occurs scan by scan of the printhead because the order in which cyan and magenta inks are superimposed differs between scanning of the printhead in the left-to-right direction and scanning of the head in the right-to-left direction. (That is, the order is cyan→magenta in the right-to-left direction and magenta→cyan in the left-to-right direction.)

In FIG. 1B, on the other hand, the filled image of the color blue is separated in the direction in which the printing paper is fed, and each individual blue image has a width that can be printed by a single scan of the printhead. In this example also color unevenness occurs scan by scan of the printhead because the blue images are printed by both the back and forth scans of the printhead, as shown in FIG. 1B.

In an actual image, however, color unevenness is much more conspicuous in FIG. 1A than in FIG. 1B. The reason for this is that if a case where images having different hues are mutually adjacent is compared with a case where they are not mutually adjacent, it will be found that the former is more easily detectable by the human eye. FIG. 1C shows a case where the printed area is very narrow. Though hue differs in a manner similar to that of FIG. 1A, color unevenness is comparatively difficult to identify if the printing area is narrow.

Table 1 below illustrates color differences between back and forth scans in a case where a continuous image is printed by causing a printing head to scan in the left-to-right direction and then in the right-to-left direction. The duty (amount of ink applied) of the continuous image is varied with the amount of cyan ink applied and the amount of magenta ink applied serving as variables.

TABLE 1

| | | AMOUNT OF MAGENTA APPLIED (%) | | | | | |
|---|---|---|---|---|---|---|---|
| | | 0 | 20 | 40 | 60 | 80 | 100 |
| AMOUNT OF CYAN APPLIED (%) | 0 | A | A | A | A | A | A |
| | 20 | A | A | A | A | B | B |
| | 40 | A | A | B | B | B | B |
| | 60 | A | A | B | C | C | C |
| | 80 | A | B | B | C | D | D |
| | 100 | A | B | B | C | D | D |

A: completely unnoticeable

B: almost unnoticeable

C: noticeable in broad areas

D: noticeable even in narrow areas

In Table 1, an applied amount of ink of 100% signifies that an ink droplet of about 4.5 pl is applied one time to paper of 1/1200 inch square for both cyan ink and magenta ink, i.e., that about 4.5 pl of ink is applied to paper of 1/1200 inch square for each of cyan ink and magenta ink. The levels A to D in Table 1 are the result of judging color unevenness as it appears to the eye. As will be evident from Table 1, the color difference is large in an area where the duty of the image is high. The image in such an area has clearly visible color unevenness as viewed by the human eye.

Further, even if the amount of ink applied is 100%, color unevenness clearly will not occur if cyan ink alone is applied in an amount of 100%. This obviously means that color unevenness will occur in a case where inks of two or more colors are applied to the same location, and that the extent of color unevenness depends largely upon the degree to which the two or more inks are mixed. The present inventors have discovered that if residual duty is defined as an index that indicates the degree to which two or more colors are mixed, color unevenness will depend largely upon this residual duty. Residual duty is the amount of ejected inks of the inks that remain after the exclusion of the ink having the highest duty among those inks printed at the same location.

The reason why color unevenness occurs is the application of inks of two or more colors to the same location on the printing medium. Accordingly, the value obtained by subtracting the amount of applied ink for which the applied amount thereof is largest from the applied amount of all inks can be said to be an appropriate value to serve as the index indicating the degree to which two or more colors are mixed. The extent of color unevenness can be predicted by using this value. For example, though printing duty is high, such as 100%, in the case of a single color, in actuality the residual duty is 0% with regard to an image in which color unevenness does not occur. Even if a value obtained by adding the printing duties of all hues is low, there will be residual duty in a case where two or more colors are mixed sufficiently to readily produce color unevenness. For example, in a case where magenta ink and cyan ink are each applied in an amount of 30%, the residual duty will be 30%.

Accordingly, by referring to the above-mentioned residual duty, it is possible to judge accurately an image in which color unevenness readily occurs and an image in which color unevenness does not readily occur. Table 2 below is obtained by indicating residual duties below the evaluation levels A to D in Table 1. It will be understood from Table 2 that color unevenness is clearly largely dependent upon residual duty.

TABLE 2

| | | AMOUNT OF MAGENTA APPLIED (%) | | | | | |
|---|---|---|---|---|---|---|---|
| | | 0 | 20 | 40 | 60 | 80 | 100 |
| AMOUNT OF CYAN APPLIED (%) | 0 | A 0% | A 0% | A 0% | A 0% | A 0% | A 0% |
| | 20 | A 0% | A 20% | A 20% | A 20% | B 20% | B 20% |
| | 40 | A 0% | A 20% | B 40% | B 40% | B 40% | B 40% |
| | 60 | A 0% | A 20% | B 40% | C 60% | C 60% | C 60% |
| | 80 | A 0% | B 20% | B 40% | C 60% | D 80% | D 80% |
| | 100 | A 0% | B 20% | B 40% | C 60% | D 80% | D 100% |

A: completely-unnoticeable

B: almost unnoticeable

C: noticeable in broad areas

D: noticeable even in narrow areas

Table 3 below indicates the relationship between residual duty and color unevenness when the color green is printed.

TABLE 3

| | | AMOUNT OF YELLOW APPLIED (%) | | | | | |
|---|---|---|---|---|---|---|---|
| | | 0 | 20 | 40 | 60 | 80 | 100 |
| AMOUNT OF CYAN APPLIED (%) | 0 | A 0% | A 0% | A 0% | A 0% | A 0% | A 0% |
| | 20 | A 0% | B 20% | B 20% | B 20% | B 20% | B 20% |
| | 40 | A 0% | B 20% | C 40% | C 40% | C 40% | C 40% |
| | 60 | A 0% | B 20% | C 40% | D 60% | D 60% | D 60% |
| | 80 | A 0% | B 20% | C 40% | C 60% | D 80% | D 80% |
| | 100 | A 0% | B 20% | C 40% | D 60% | D 80% | D 100% |

A: completely unnoticeable

B: almost unnoticeable

C: noticeable in broad areas.

D: noticeable even in narrow areas

Comparing Tables 2 and 3 shows that color unevenness is clearly more conspicuous in Table 3. It is believed that this is because yellow ink exhibits a large difference in lightness with respect to magenta and cyan.

Table 4 below shows the relationship between residual duty and color unevenness when black and cyan inks are printed.

TABLE 4

| | | AMOUNT OF BLACK APPLIED (%) | | | | | |
|---|---|---|---|---|---|---|---|
| | | 0 | 20 | 40 | 60 | 80 | 100 |
| AMOUNT OF CYAN APPLIED (%) | 0 | A 0% | A 0% | A 0% | A 0% | A 0% | A 0% |
| | 20 | A 0% | A 20% | A 20% | A 20% | A 20% | A 20% |
| | 40 | A 0% | A 20% | A 40% | A 40% | A 40% | A 40% |
| | 60 | A 0% | A 20% | A 40% | B 60% | B 60% | B 60% |
| | 80 | A 0% | A 20% | A 40% | B 60% | B 80% | B 80% |
| | 100 | A 0% | A 20% | A 40% | B 60% | B 80% | B 100% |

A: completely unnoticeable

B: almost unnoticeable

C: noticeable in broad areas

D: noticeable even in narrow areas

If Table 4 is compared with Tables 2 and 3, it will be appreciated that the degree of color unevenness is clearly less in Table 4. It is believed that this is because pigment ink is used as the black ink, and black ink is the dominant contributor to optical density. Thus it is obvious that the degree to which color unevenness occurs differs depending also upon the hue of the ink. Accordingly, by applying a hue-by-hue weighting coefficient after printing duty is calculated, it is possible to ascertain the circumstances of color unevenness more accurately.

In a situation where printing is performed by causing a printhead to scan back and forth, color unevenness does not always occur, as explained above. That is, color unevenness is not readily noticeable (FIG. 1B) if images smaller than the scanning width of the printhead are not mutually adjacent. Conversely, even though the image may be larger than the scanning width of the printhead, color unevenness can be said to be difficult to notice (Tables 1 and 2) if the residual duty of the image is not high. Furthermore, color unevenness is comparatively unnoticeable (FIG. 1C) even in a case where the size of the image in the main-scan direction is small. In addition, it is obvious that color unevenness differs (Tables 3 and 4) depending also upon the hues of the inks used.

The present embodiment controls the execution of back-and-forth printing and unidirectional printing by utilizing the above-mentioned characteristic and adopts the higher speed of printing afforded by back-and-forth printing and the higher image quality afforded by unidirectional printing to thereby achieve high-speed, high-quality printing. The control procedure includes first calculating the printing duty of each ink in a prescribed area of an image, then applying a higher weighting coefficient to an ink for which color unevenness readily occurs, applying a lower weighting coefficient to an ink for which color unevenness does not readily occur, and calculating residual duty based upon the weighted printing duty of each ink that has undergone weighting.

The scanning direction for the next scan area can be determined based on the residual duty calculated for the next scan area. For example, when the residual duty for the next scan area exceeds a predetermined threshold value, the direction of the printing scan is decided in a predetermined direction. When the residual duty for the next scan area does not exceeds the predetermined threshold value, the printing is performed bidirectionally.

Furthermore, according to more preferable embodiments, in the case of an image that corresponds to an edge portion (boundary portion) of the printhead scanning width for which the color unevenness is comparatively noticeable, a low threshold value is used. In an area other than the boundary portion of the printhead scanning width for which the color unevenness is comparatively difficult to notice, a high threshold value is used. If a threshold value is exceeded, the number of adjacent areas that exceed the threshold value are counted, thereby making it possible to judge the width of an area in which color unevenness is readily noticeable. If even one of the edge portion and central portion of the printhead is judged to be readily susceptible to color unevenness, printing is performed by scanning either in the left-to-right direction or in the right-to-left direction. Conversely, if even one of these portions is judged not to be readily susceptible to color unevenness, then printing is performed bidirectionally, namely in the left-to-right scanning direction and the right-to-left scanning direction.

An inkjet printing apparatus and a method of controlling the same according to an embodiment of the present invention will now be described in detail with reference to the drawings.

Structure of Inkjet Printing Apparatus

Figure 2:
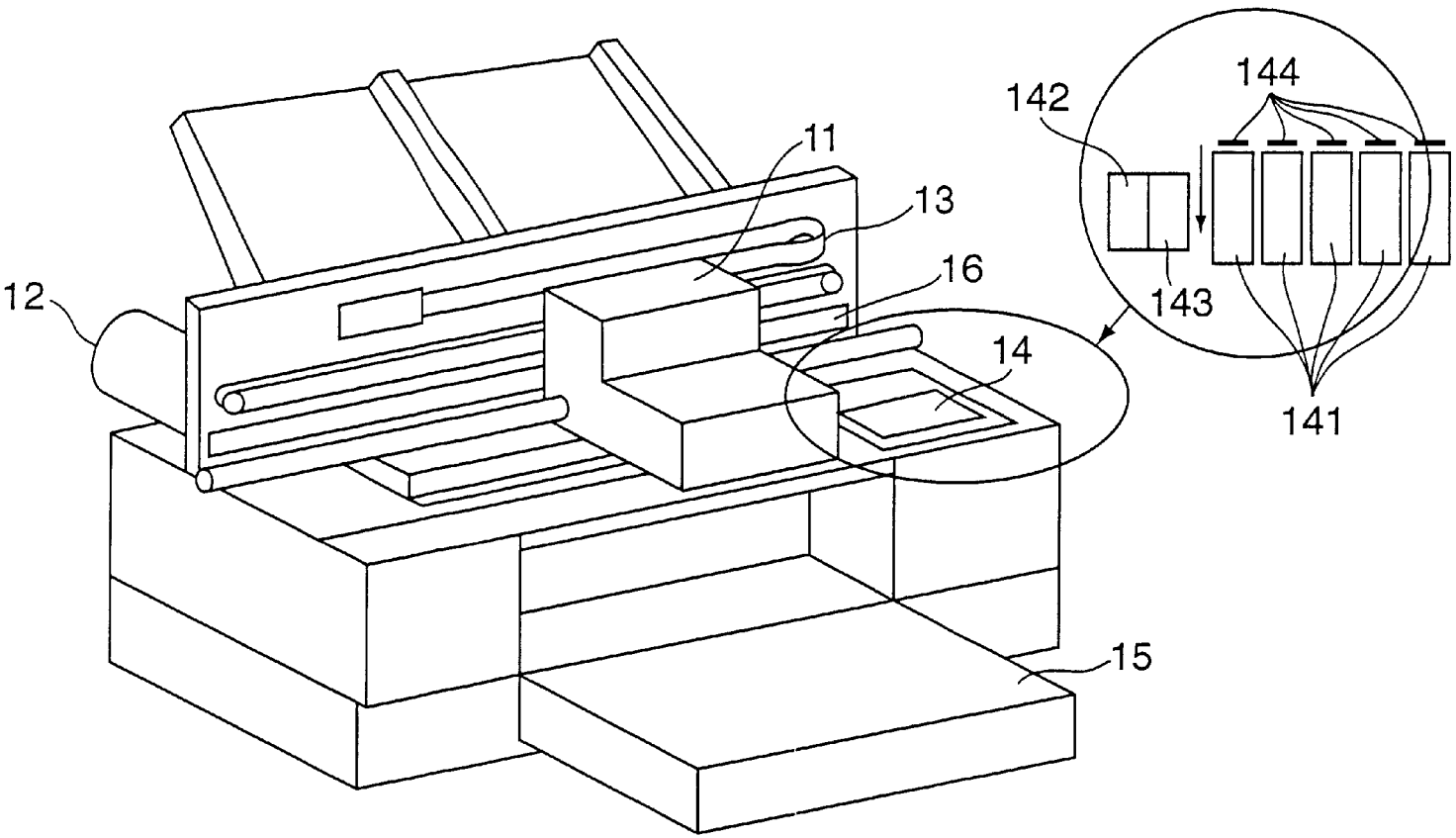
FIG. 2 is a diagram useful in describing the general structure of an inkjet printing apparatus according to an embodiment.

FIG. 2 is a diagram illustrating the external appearance of an inkjet printing apparatus used in this embodiment. The apparatus includes a carriage 11 on which an inkjet cartridge is mounted; a carriage motor 12 for moving the carriage 11 in the main-scan direction; a flexible cable 13 for sending an electric signal from a controller (not shown) of the apparatus to the inkjet cartridge; recovery means 14 for subjecting an inkjet head unit to recovery processing; a paper supply tray 15 for storing, in stacked form, printing paper serving as a printing medium; and a optical position sensor 16 for optically reading the position of the carriage. The inkjet printing apparatus having this structure causes the carriage 11 to perform serially scanning so as to carry out printing over a width corresponding to the orifices (number of nozzles) of the inkjet head. When printing is not being performed, the printing paper is transported a prescribed amount intermittently by a transport motor, which is not shown.

The recovery means 14 includes suction and caps 141, an ejection receptacle 142 for receiving treatment liquid ejected at the time of ejection recovery, an ejection receptacle 143 for receiving ink ejected at the time of ejection recovery, and wiper plates 144 for wiping off the surface. The wiper plates 144 wipe the surface while being moved in the direction of the arrow.

Figure 3:
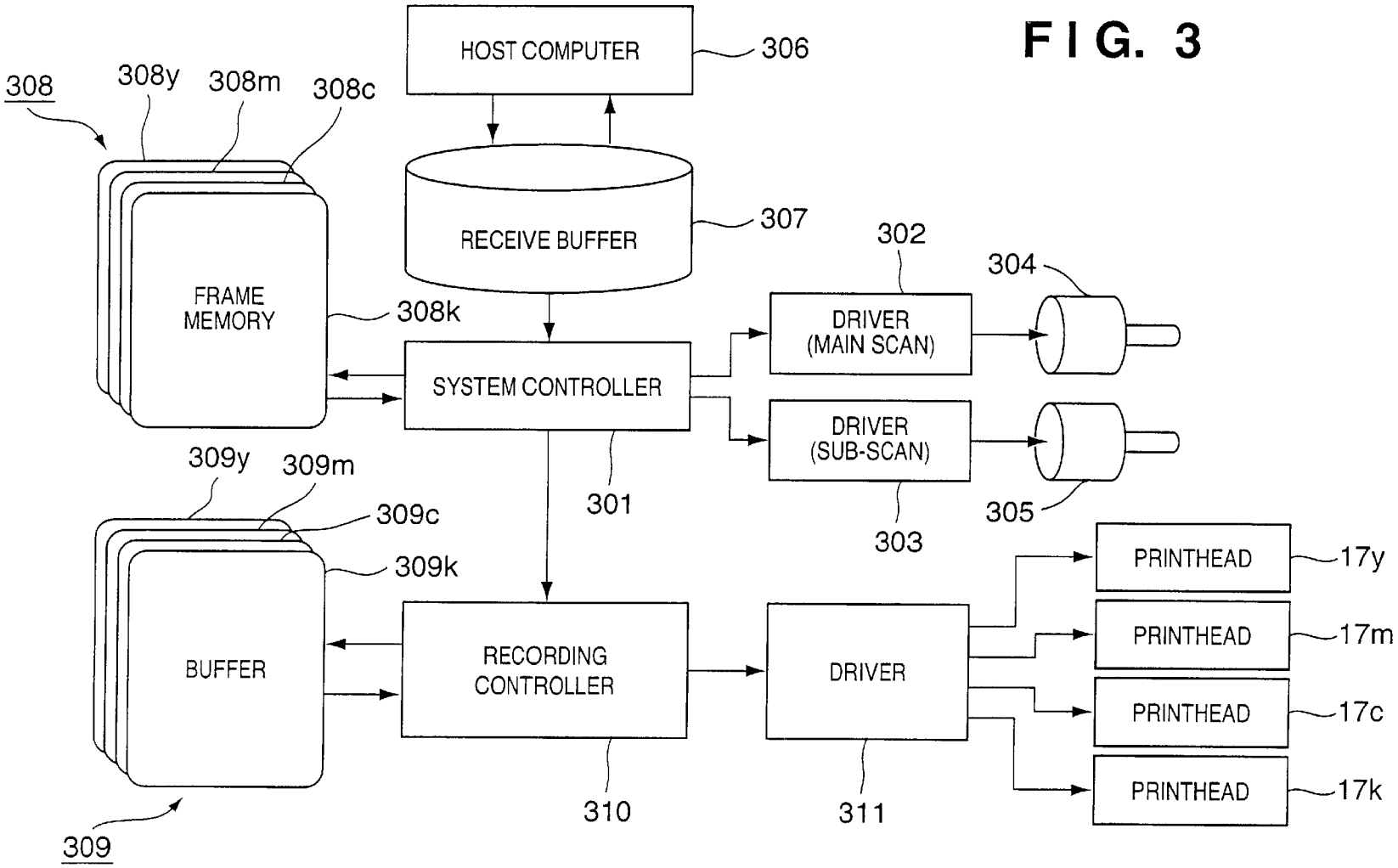
FIG. 3 is a diagram useful in describing the block structure of the inkjet printing apparatus used in this embodiment.

FIG. 3 is a block diagram illustrating an example of the structure of an electrical control system in the inkjet printing apparatus shown in FIG. 2.

The control system includes a system controller 301 for controlling the overall apparatus. The system controller 301 incorporates a microprocessor and a storage device (ROM) in which the control program has been stored. The control system further includes a motor (carriage motor 12) 304 for driving the printhead in the main-scan direction, a motor (transport motor) 305 for intermittently transporting the printing paper a prescribed amount, and drivers 302, 303, which receive information relating to the travelling speeds and travelling distances of the printhead and printing paper from the controller 301, for driving the motors 304 and 305, respectively.

A host computer 306 transfers information to be printed to the inkjet printing apparatus of this embodiment. The host computer 306 can have the form of a computer serving as an information processor or the form of an image reader. A receive buffer 307 is for temporarily storing data from the host computer 306. The receive buffer 307 accumulates received data until data is read in from the system controller 301.

A frame memory 308 (308*k*, 308*c*, 308*m*, 308*y*) develops data, which is to be recorded, into image data. Each frame memory has a memory size needed to record the data of the corresponding color. Though the frame memory described is capable of recording data corresponding to one page of the recording paper, it goes without saying that the memory is not limited to this size. A storage device 309 (309*k*, 309*c*, 309*m*, 309*y*) functions as a buffer for temporarily storing data to be recorded. The recording capacity varies in accordance with the number of nozzles of the printhead.

A recording controller 310 controls the printhead appropriately in accordance with a command from the system controller 301. The recording controller 310 controls printing speed and number of items of print data, etc. A driver 311 is controlled by a signal from the recording controller 310 and drives printheads 17*k*, 17*c*, 17*m* and 17*y* for ejecting ink. The printheads 17*k*, 17*c*, 17*m* and 17*y* correspond to the colors black, cyan, magenta and yellow, respectively.

In the arrangement described above, image data supplied from the host computer 306 is transferred to and stored temporarily in the receive buffer 307 and is developed in the frame memories of the respective colors. Next, the developed image data is read out by the system controller 301 and is then developed in the buffer 309 color by color. The recording controller 310 controls the operation of the printheads 17*k*, 17*c*, 17*m*, 17*y* based upon the image data in each of the buffers.

Figure 4:
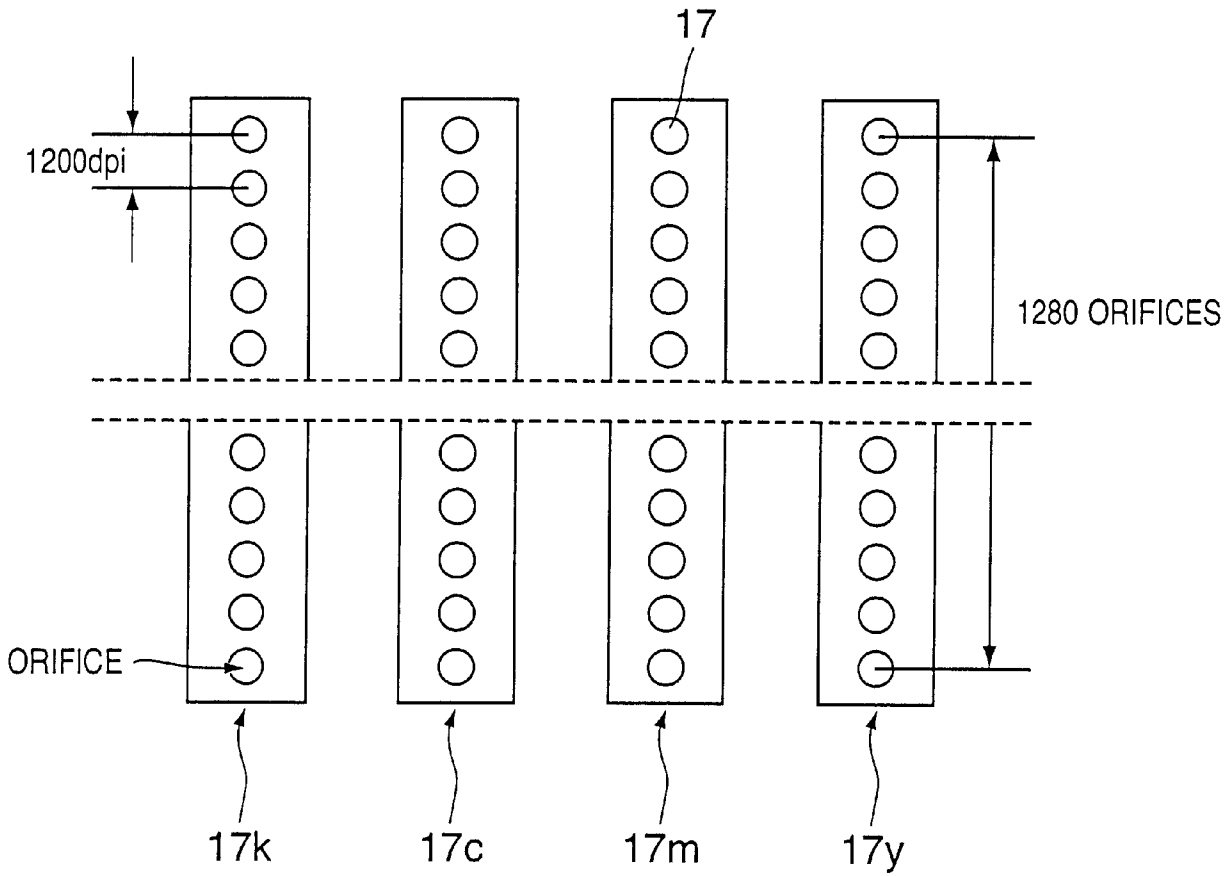
FIG. 4 is a diagram useful in describing the arrangement of an inkjet head used in this embodiment.

FIG. 4 is a diagram illustrating the printheads of this embodiment as seen from the side of the orifices. Each printhead has a row of 1280 orifices at a density of 1200 per inch. The printheads 17*k*, 17*c*, 17*m* and 17*y* for ejecting inks of the colors black, cyan, magenta and yellow, respectively, are arranged in the direction in which the printheads scan the printing paper. The amount of ink ejected from the orifices is about 8 ng for the black ink and about 4.75 ng for each of the other inks. Here a large amount of the black ink is ejected in order to realize high density.

Control of Scanning Direction of Inkjet Printing Apparatus

The printing method carried out by the inkjet printing apparatus constructed as set forth above will now be described in greater detail. In this embodiment, control which executes printing in one direction is implemented in regard to an area in which it is judged that color unevenness will be caused by back-and-forth printing. This makes it possible to maintain the quality of the printed image at a high level while achieving an increase in speed obtained by back-and-forth printing by the printhead.

Described first will be a method of detecting and determining whether color unevenness will occur scan by scan when an image is printed by alternately repeating scanning of the printhead in the left-to-right direction and right-to-left direction.

Figure 5:
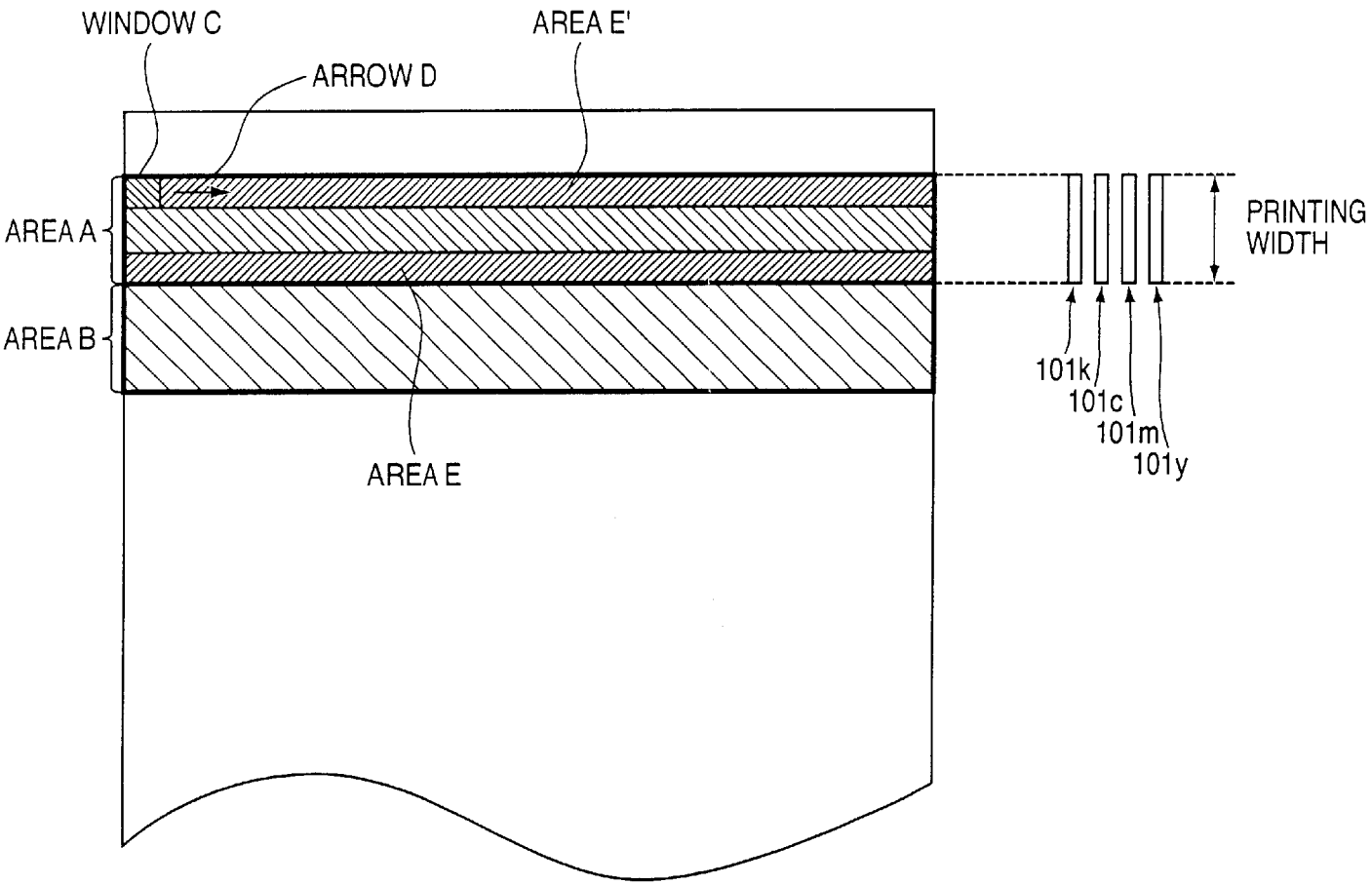
FIG. 5 is a diagram useful in describing a window for calculating residual duty in a first embodiment.

FIG. 5 is a diagram illustrating a method of calculating printing duty of a prescribed zone in an image area, which is now to be printed, of 1280 dots (printhead width)× scanning width of the printhead. In FIG. 5, area A indicates an area to be printed now (the area A is actually image data of the area to be printed), and an area B indicates an area to be printed next. As shown in FIG. 5, a window C is provided, the window C is caused to scan the image area and the printing duty within the window C is calculated. The window C has a size of 128 dots longitudinally by 128 dots horizontally (resolution in the horizontal direction is 1200 dots per inch, i.e., 1200 dpi) and is caused to scan so that the printing duty across the entire width of the printhead (the entirety of area A) may be calculated.

In the scanning of the window C, printing duty is calculated while the window C is shifted in increments of the window size (128 dots horizontally in this embodiment) in the direction of arrow D, i.e., in the scanning direction of the printhead in FIG. 5. In this embodiment, the window C is moved from left to right for the sake of convenience. The lower edge of the area A, which is a boundary area E with respect to the next printing area B, and the upper edge of the area A, which is a boundary area E' with respect to the previous printing area, shall be referred to as "boundary portions". The printing area in area A from which the boundary portions have been excluded shall be referred to as a "central portion".

In this embodiment, a weighting coefficient of 1 is applied to the cyan, magenta and yellow inks, and a weighting coefficient of 0 is applied to the black ink. As a consequence, a weighting calculation is not performed with regard to the colors cyan, magenta and yellow, the printing duty is used as is in calculation of residual duty, and the black ink is not allowed to participate in the calculation of residual duty. The reason for this is that the duty of the black ink has little influence upon the occurrence of color unevenness, as indicated in Table 4.

Printing duties Dc, Dm and Dy of the cyan, magenta and yellow images, respectively, within the window C are counted, and the sum Dc+Dm+Dy of the duties is adopted as the total duty Dtotal within the window. Accordingly, the maximum value of total duty is 300%. Next, maximum duty is calculated with regard to each of the duties of cyan, magenta and yellow and shall be represented by Dmax. The difference between total duty and maximum duty shall be represented by Dr (=Dtotal−Dmax), and this difference will be adopted as the residual duty. Next, a threshold value with respect to the residual duty Dr is set to 30% at the boundary portions of the image and to 100% at the central portion of the image.

If a printing area in which the residual duty exceeds the threshold value is found three times in succession in a boundary portion or five times in succession in the central portion, then printing (unidirectional printing) is performed in whichever of left-to-right and right-to-left scanning directions is designated beforehand. If such a prescribed group of areas in which the threshold value is exceeded successively in this manner does not exist over the entirety of the image area, then printing (back-and-forth printing) is performed using both the left-to-right and right-to-left scanning directions.

Figure 6:
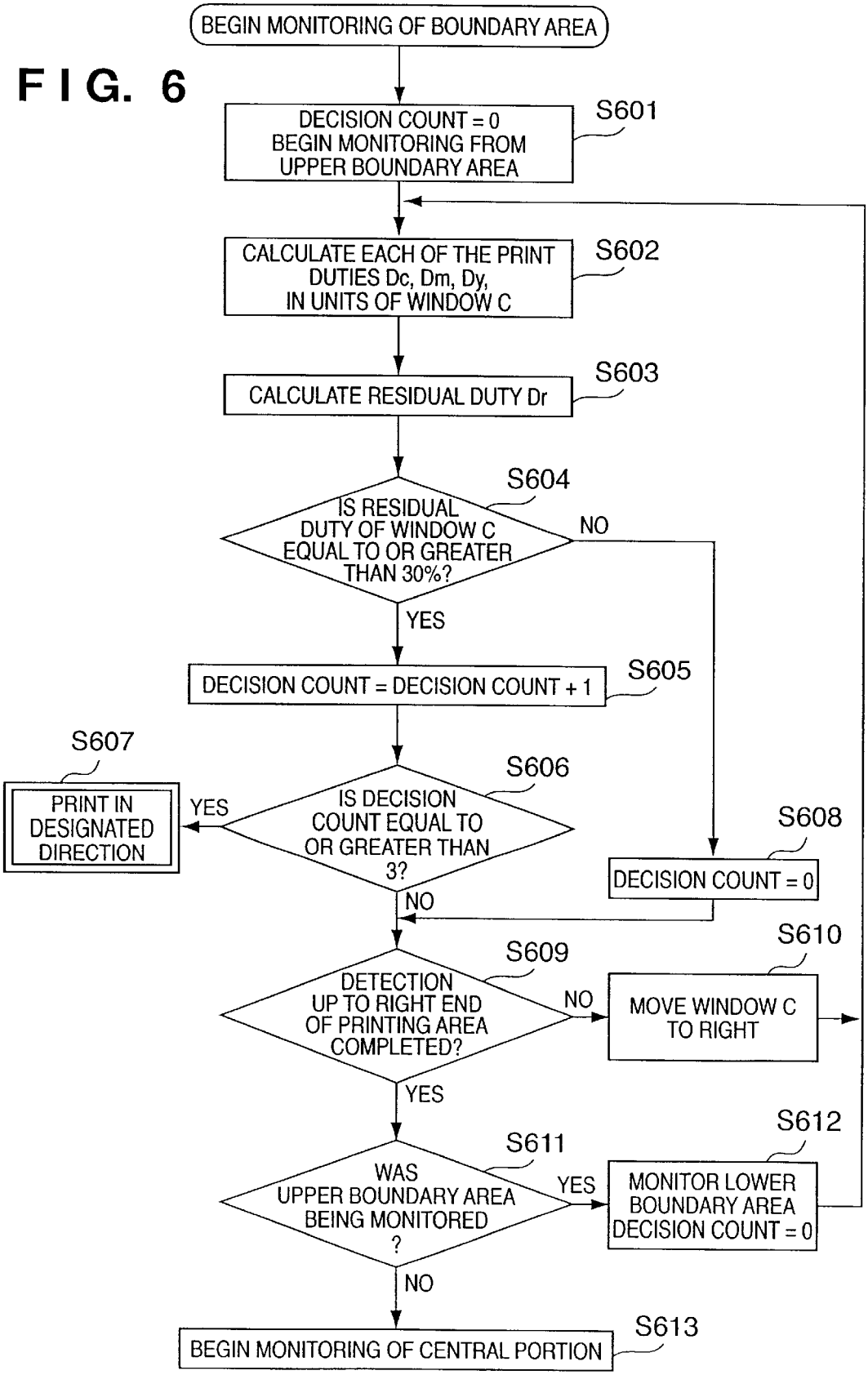
FIG. 6 is a flowchart useful in describing processing for deciding scanning direction in the first embodiment.

FIGS. 6 and 7 are flowcharts illustrating the above-described operation. Control for designating unidirectional printing and back-and-forth printing according to this embodiment will be described with reference to the flowcharts of FIGS. 6 and 7.

First, at step S601 in FIG. 6, a decision count is made 0 as an initializing operation and the upper boundary area (area E' in FIG. 5) of the image area that is to be printed now starts being monitored. That is, the window C is placed at the left end of the boundary area E'. Next, at step S602, the duties of the colors cyan, magenta and yellow are counted in the zone occupied by the window C. In this embodiment, a weighting calculation is not performed with respect to the counting of duty. The residual duty Dr is calculated at step S603 using the calculated duties. More specifically, the difference between the total (Dtotal) of the duties of the respective colors and the maximum value (Dmax) of duty is calculated.

Next, at step S604, the residual duty Dr found at step S603 is evaluated. Here the lower threshold value of 30% is used because a boundary area is being monitored. It is determined whether the residual duty Dr is equal to or greater than the threshold value of 30%. If the residual duty Dr is less than 30% ("NO" at step S604), the decision count is returned to 0 at step S608 and control proceeds to step S609.

If the residual duty Dr is equal to or greater than the threshold value of 30% ("YES" at step S604), control proceeds to step S605, where the decision count is incremented by 1. It is then determined at step S606 whether the decision count is 3 or greater in order to judge whether the residual duty has become equal to or greater than 30% three or more times in succession. If it is found that the count is 3 or greater ("YES" at step S606, then it is judged at this time that areas having a high residual duty Dr exist contiguously in the boundary portion. Monitoring is therefore halted and printing in the designated direction (i.e., unidirectional printing) is carried out at step S607. If it is found that the count is 2 or less ("NO" at step S606), control proceeds to step S609.

It is determined at step S609 whether the evaluation window C has arrived at the right end of the image. If the window C has not arrived at the right end ("NO" at step S609), control proceeds to step S610, where the window C is moved rightward by an amount equivalent to the width of the window. Control then returns to step S602, where monitoring is continued. When the window C thus eventually arrives at the right end ("YES" at step S609), the upper boundary area ends. Accordingly, control proceeds to step S611 in order to move the window C to the next area.

By repeating this processing, it is possible to monitor the entire upper boundary area E' of the image that is to be printed now. If it is found that areas having a high residual duty do not exist contiguously in the upper boundary area of the image, control proceeds from step S609 to step S611 to move to monitoring of the next area. If the upper boundary area E' was being monitored, then the residual duty of the lower boundary area E of the image area is monitored as the next area by an operation similar to that described above. That is, control proceeds from step S611 to step S612, where the window C is placed at the left end of the lower boundary area E, the decision count is initialized to 0 and control returns to step S602.

If it is found that areas of high residual duty do not exist contiguously in the lower boundary area as well, then control proceeds from step S611 to step S613. Here the residual duty in the central portion of the image is monitored by calculation similar to that described above.

FIG. 7 is a flowchart illustrating the operation for monitoring the central portion of the image. The processing of steps S701 to S710 is similar to the processing of steps S601 to S610 described above. However, since the central portion does not contact the next area to be printed or the preceding printed area, the higher threshold value (100%) is used at step S704.

When the window C arrives at the right edge, control proceeds from step S711 to step S712. Here the window C is moved to the left end of the next lower level, the decision count is initialized to 0 and control returns to step S702. If the entire area of the central portion is thus monitored and it is determined that areas of high residual duty do not exist contiguously in this portion, control proceeds from step S711 to step S713 and direction is not designated. In other words, it is decided that bidirectional printing should be carried out. If it is decided that bidirectional printing should be carried out, it will suffice to exercise control so as to carry out scanning in a direction opposite that of the immediately preceding scan, by way of example. However, if it is so arranged that scanning is always performed in the direction opposite that of the immediately preceding scan, it will be necessary to move the printhead across the entire scan area scan by scan even when there is an image in the left-hand part of the preceding scan area and only the right-hand part of the image is in the next scan area. The result is low efficiency. Accordingly, control may be performed advantageously as follows: If it has been decided that printing in a designated direction is not to be carried out, then, in order to select the scanning procedure that will take the shortest amount of time, the printhead is halted at the terminus of the left-hand part of the printing scan in a case where only the left-hand part of the previous scan area has an image and this has been scanned from the left side and, moreover, only the right-hand part of the next scan area has an image. The printing paper is then transported and, after paper transport, printing is performed from left to right as is. In other words, printing is performed twice while keeping the scanning direction the same.

Figure 8:
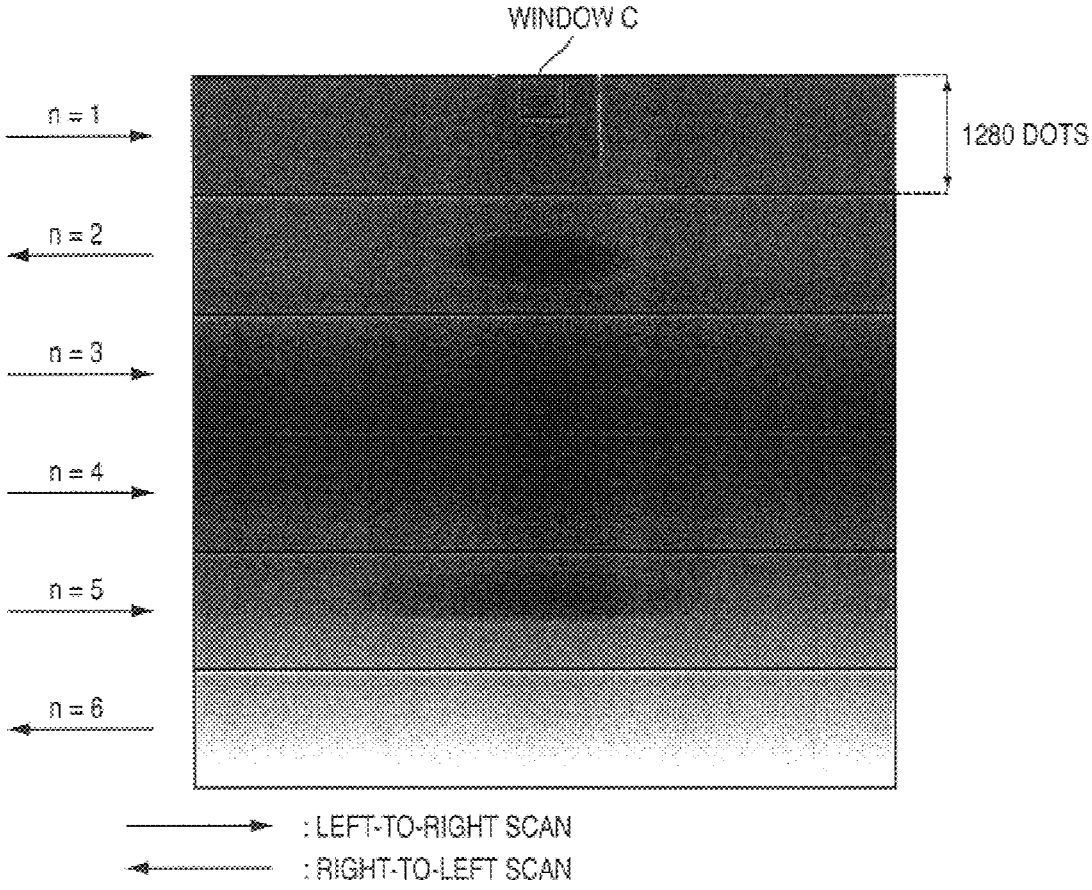
FIG. 8 is a diagram useful in describing a printing operation according to the first embodiment.

FIG. 8 is a diagram useful in describing an example to which the present invention is applied. Residual duty is calculated window by window first at the edge portions in an area of a first scan (n=1). It will be assumed here that the decision count has not reached 3 even once in both the upper and lower boundary areas. Residual duty is then calculated using the window C in the central portion. Here also it will be assumed that the decision count has not reached 5. As a result, direction is not designated in the first scan and the printing direction in this case is made the left-to-right scanning direction. The printing direction in this case may be either direction because no designation has been made. The direction is decided depending upon where the printhead is located at the particular time. The description rendered here assumes that the first scan (n=1) is the left-to-right scan. Next, the second scan is performed. In this case it is assumed that three areas in which the residual duty exceeds 100% exist contiguously in the central portion. In this case, it is judged that color unevenness is not noticeable because the portion is the central portion and the area also is comparatively narrow (the contiguous areas in which 100% is exceeded are less than five in number). As a consequence, direction is not designated in this scan either. Since it was assumed that the first scan was a left-to-right scan, the printhead is present on the right side in FIG. 8. In order to shorten time, therefore, printing is started from the right, i.e., right-to-left printing is carried out (n=2).

In the third scan (n=3), it is assumed that four areas in which the residual duty exceeds 30% exist contiguously at the lower edge. In this case, the decision count exceeds 3 and therefore printing is performed in a designated direction. The designated direction is a direction that has been decided in advance. In this embodiment, it is decided that the designated direction is the left-to-right direction and, hence, printing is carried out from left to right.

In the fourth scan (n=4), it is assumed that four areas in which the residual duty exceeds 30% exist contiguously at the upper edge. In this case also the decision count exceeds 3 and therefore printing is performed in the left-to-right scanning direction, which is the designated direction. Originally, printing would have been performed in the right-to-left scanning direction because printing was carried out in the left-to-right scanning direction in the third scan. However, since it is predicted that color unevenness will occur, printing is carried out again in the left-to-right scanning direction. As a result, at the boundary where there is the danger that color unevenness will occur between the third and fourth scans, printing is performed in the left-to-right scanning direction in both scans. This makes it possible to suppress the occurrence of color unevenness.

Next, in the fifth scan (n=5), it is assumed that six areas in which the residual duty exceeds 100% exist contiguously in the central portion. In this case the decision count exceeds 5 and therefore printing is performed in the designated direction. The designated direction is the left-to-right direction, as mentioned above. Originally, printing would have been performed in the right-to-left scanning direction because printing was carried out in the left-to-right scanning direction in the fourth scan. However, since it is predicted that color unevenness will occur, printing is carried out in the left-to-right scanning direction. As a result, an image in the central portion of the fifth scan where there is the danger that color unevenness will occur between the fourth and fifth scans or between the sixth and fifth scans is printed in the left-to-right scanning direction. This makes it possible to suppress the occurrence of color unevenness.

In the sixth and final scan, it is assumed that a group of areas of high residual duty does exists neither at the edge portions nor in the central portion. As a result, the printing direction of the sixth scan is opposite that of the fifth scan and printing is performed by a right-to-left scan. Though an area in which color unevenness may occur is present in the broad area of the central portion of the fifth scan, an area that is to be compared does not exist in the sixth scan and therefore color unevenness will not be noticeable. Accordingly, bidirectional printing is designated.

Thus, in accordance with the first embodiment as described above, residual duty of a prescribed area within a scan over which printing is to be performed now is calculated, back-and-forth printing is performed when the residual duty is low and unidirectional printing is performed when the residual duty is high. As a result, an image in which color unevenness is not conspicuous can be printed at high speed.

Color-unevenness Evaluation That Takes Hue Into Consideration

In a case where a secondary-color image of red, green and blue is printed back and forth, the degree to which color unevenness occurs owing to the left-to-right and right-to-left scans differs. It is believed that this is ascribable to the characteristics of the inks, as described in connection with Table 3, and to a difference in time in color overlap caused by the physical distance between heads of the respective colors. When printing duty is calculated within a prescribed area taking this into account, an image of even higher quality can be printed at high speed if it is so arranged that the printing duty of a specific color is calculated besides simply calculating the sum of the printing duties of the respective colors.

By way of example, we will describe a case where green and red exhibit color unevenness that is more easily noticeable in comparison with blue in a situation where secondary-color images of the same duty are printed back and forth. When printing duty is converted to weighting duty in such case, weighting of 1.5 times is applied with regard to the duty of yellow ink. As a result, residual duty occurs to an increased degree in the green and red images so that it is possible to prevent color unevenness in green and red.

Further, in a case where pigment ink is used as the black ink or use is made of ink that reacts with color ink, there are examples where color unevenness does occur between the black ink and the color ink. In such cases the black ink may be excluded from calculation of residual duty by adopting 0 as the weighting parameter for black ink.

Modification

In a case where color unevenness is evaluated in inks of the three hues cyan, magenta and yellow, discriminating the ink type having the second highest printing duty based upon the magnitude of color unevenness evaluated and using this printing duty as the residual duty can be done in simple fashion. This value shall be referred to as the simple residual duty. For example, if maximum duty is exhibited by cyan ink and the second highest duty is exhibited by magenta ink, then the simple residual duty will be the duty of magenta ink. The above-mentioned residual duty found between the total duty and maximum duty in this case will be a value that is twice the simple residual duty if yellow has the same value as that of magenta. Hypothetically, therefore, a value obtained by doubling the simple residual duty can be construed to be the residual duty. Alternatively, the same effect can be obtained by halving the threshold value with regard to the simple residual duty.

<Second Embodiment (Two-pass Printing)>

In the first embodiment, we have described a method of evaluating color unevenness in case of single-pass printing as well as control of back-and-forth printing. A case in which two-path printing is performed will be described in a second embodiment.

Evaluation of Color Unevenness in Two-pass Printing

Figure 9:
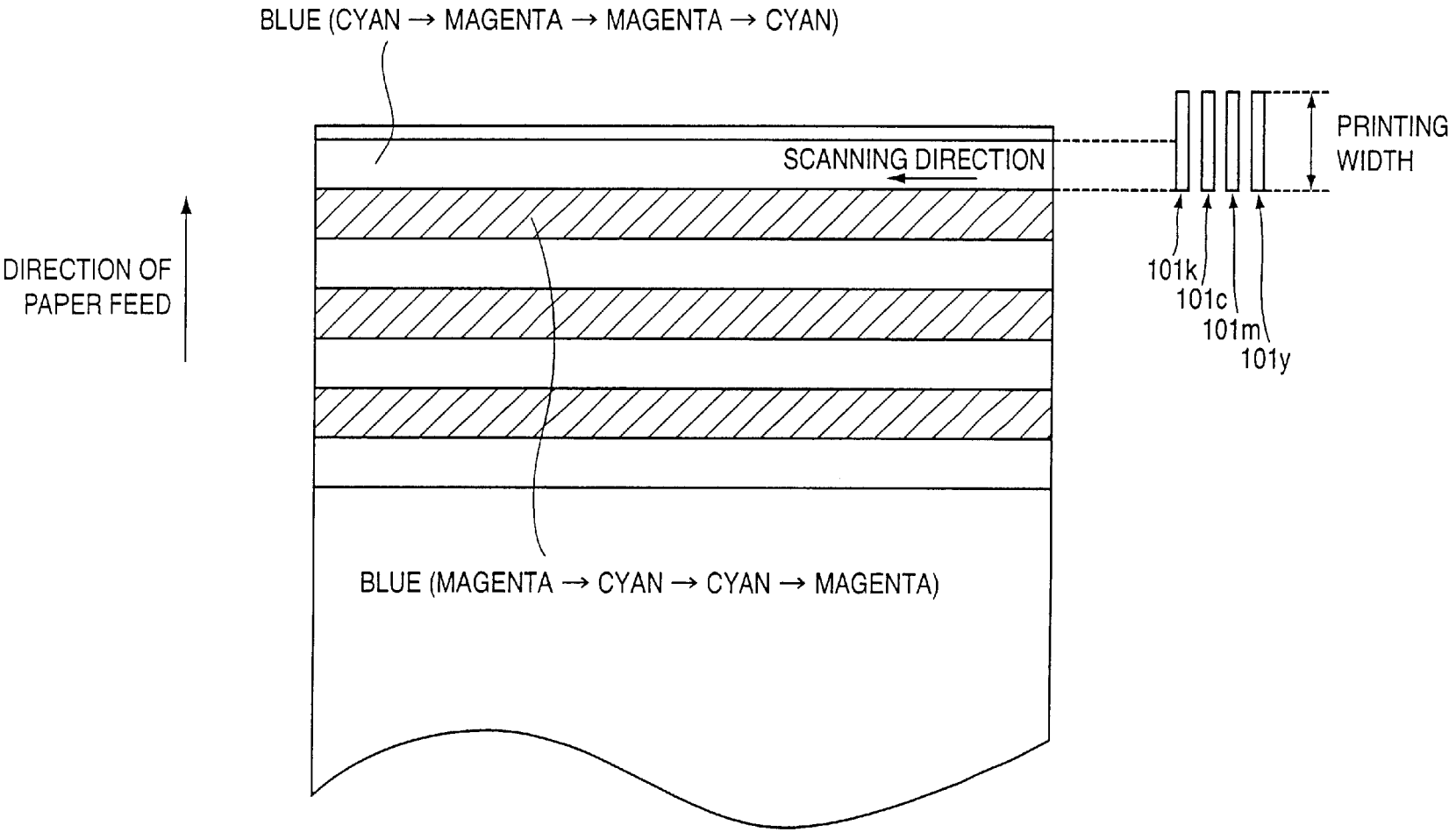
FIG. 9 is a diagram useful in describing color unevenness when back-and-forth printing is performed in two passes.

FIG. 9 shows color unevenness when back-and-forth printing is performed in two passes. FIG. 9 is for describing an example in which a filled image of the secondary color blue is printed, in two-pass printing, by a printhead in which the nozzles are arrayed in the scanning direction to eject black ink, cyan ink, magenta ink and yellow ink.

FIG. 9 illustrates an example in which a blue image having an area broader than the width of a single scan of the printhead is printed. In the case of two-pass printing according to the prior art, the order in which cyan and magenta overlap differs between the left-to-right and right-to-left scans of the printhead and, as a consequence, color unevenness occurs in every area the length of which is half the scanning width of the printhead. The reason for this is as follows: whereas the printing area that is printed starting with cyan ink is printed in the order cyan→magenta→magenta→cyan, the printing-area that is printed start with magenta ink is printed in the order magenta→cyan→cyan→magenta.

The cause of color unevenness depends largely upon residual duty in this printing method also. Table 5 below illustrates a subjective visual evaluation of color unevenness and residual duty in a case where the printing duties of cyan ink and magenta ink are each varied up to a value of 100% in six stages in two-pass printing. It should be noted that the range of printing duties are 0 to 50% in the table 5 since printing duties for each pass of two-pass printing are indicated.

TABLE 5

| | | AMOUNT OF MAGENTA APPLIED (%) | | | | | |
|---|---|---|---|---|---|---|---|
| | | 0 | 10 | 20 | 30 | 40 | 50 |
| AMOUNT OF CYAN APPLIED (%) | 0 | A 0% | A 0% | A 0% | A 0% | A 0% | A 0% |
| | 10 | A 0% | A 10% | A 10% | A 10% | B 10% | B 10% |
| | 20 | A 0% | A 10% | B 20% | B 20% | B 20% | B 20% |
| | 30 | A 0% | A 10% | B 20% | C 30% | C 30% | C 30% |
| | 40 | A 0% | B 10% | B 20% | C 30% | D 40% | D 40% |
| | 50 | A 0% | B 10% | B 20% | C 30% | D 40% | D 50% |

A: completely unnoticeable

B: almost unnoticeable

C: noticeable in broad areas

D: noticeable even in narrow areas

Figure 10:
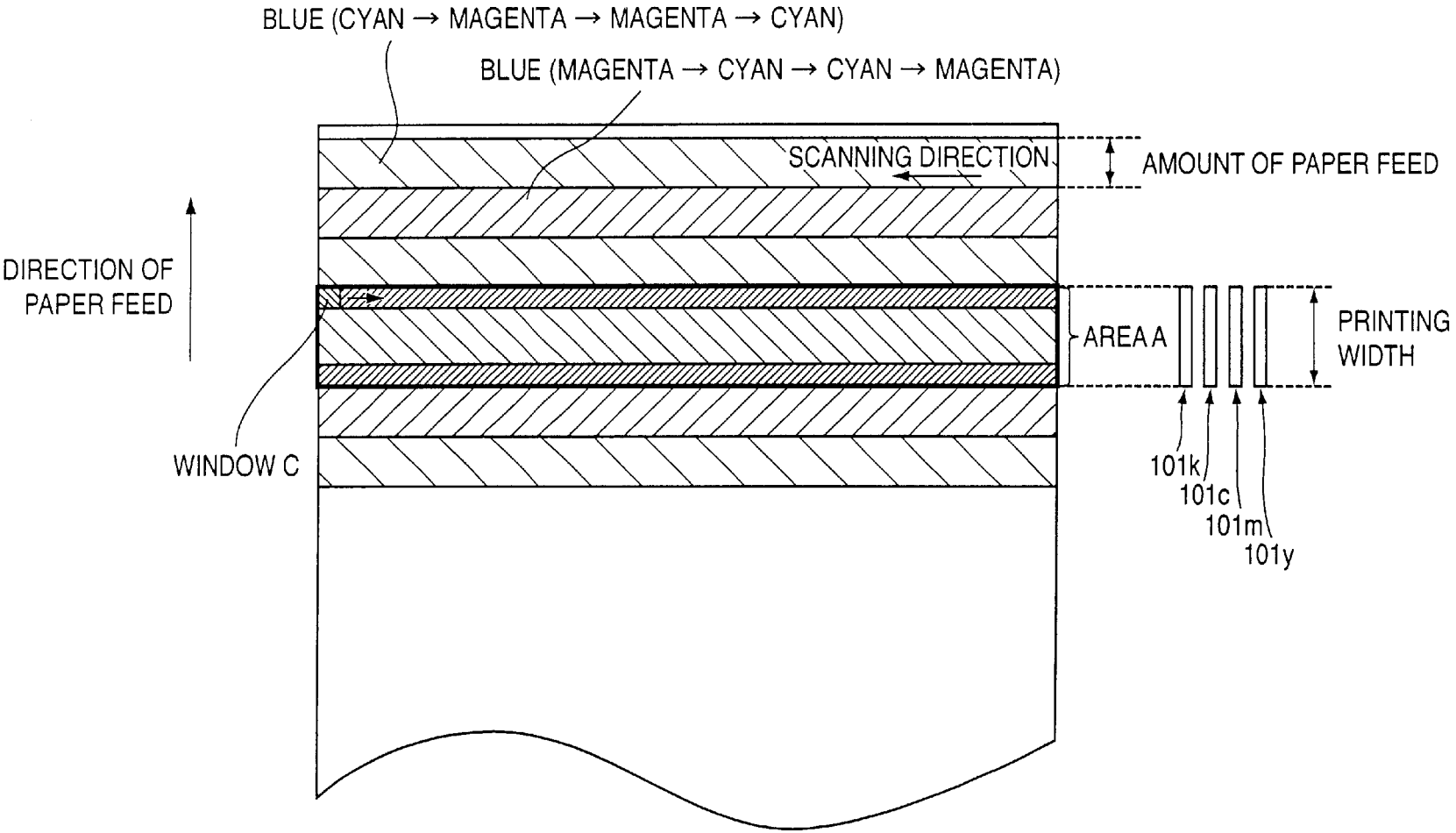
FIG. 10 is a diagram useful in describing a window for calculating printing duty in a case where back-and-forth printing is performed in two passes.

Furthermore, as pointed out in the first embodiment, the boundary of the left-to-right and right-to-left scans is where color unevenness is easy judge visually. Therefore, residual duty is calculated in each area defined by dividing the printing area (the image data in actuality), as shown in FIG. 10. Furthermore, in an area that corresponds to an edge portion of the printhead scanning width for which the color unevenness is comparatively noticeable, an applicable low threshold value is used even if the duty is low. In an area other than the edge portion of the printhead scanning width for which the color unevenness is comparatively difficult to notice, a high threshold value is used unless the residual duty is high. If it is judged that color unevenness is likely to occur in either of these areas, then printing is performed in a prescribed direction, which is either the left-to-right or right-to-left direction.

In this embodiment, the amount of movement of the printing medium in a single transport of the medium is half the printing width in order that two-path printing may be carried out; printing is performed twice with regard to the same image. This means that the residual duty of the same location is calculated twice. In order to eliminate such redundant calculation, it is possible to exercise control so as to calculate residual duty only in an area that is on the leading half of the scanning width. The area (image data) in which printing duty is to be sensed in the first main scan is half the printing width of the printhead, as indicated in area A of FIG. 11. This is an area on the leading side with respect to the direction in which the printing medium is transported. In the case of two-pass printing, it will suffice to perform printing in the prescribed direction two or three times in succession if it is judged that color unevenness will readily occur.

It goes without saying that this method can be applied also to multiple-pass printing, such as four-pass printing.

Two-pass printing according to this embodiment is completed by two main scans of one area. The size of the window, which is the area in which printing duty is calculated, is the same as that of the window (window C) of the first embodiment. The threshold value for evaluating color unevenness using residual duty is a duty value that is half that of the first embodiment because an image is completed by two scans.

Figure 11:
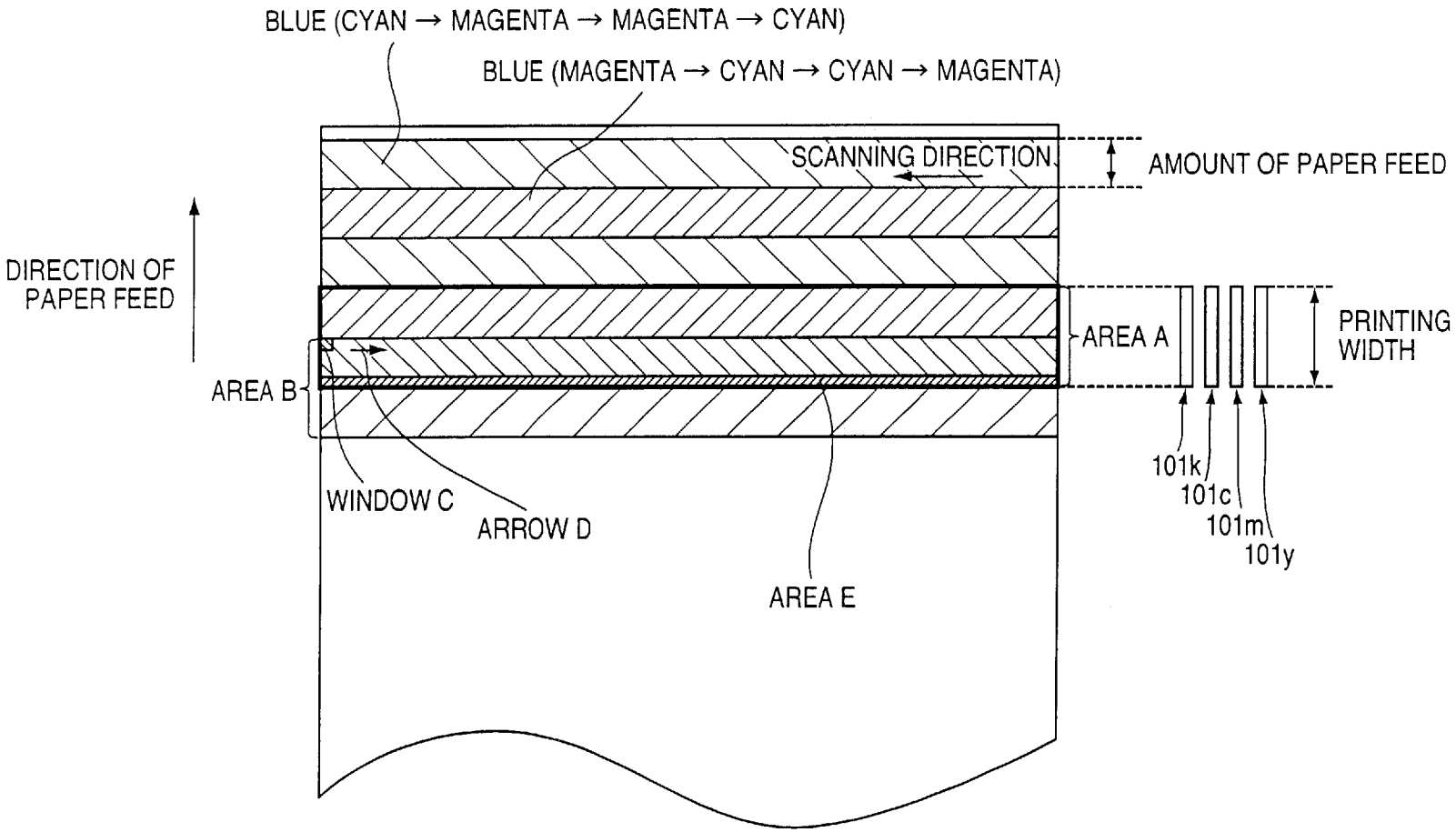
FIG. 11 is a diagram useful in describing a window for calculating residual duty in a case where back-and-forth printing is performed in two passes.

FIG. 11 illustrates a method of calculating printing duty of a prescribed zone in an image area, which is now to be printed, of 1280 dots (printhead width)×scanning width of the printhead. The area A is the area that is to be printed now. Further, the area B is the area to be printed next. First, the detection window C is provided. The window is made to scan the image area and printing duty within the window is calculated. In area A, the upper half is an area that was printed in the preceding scan and the residual duty is not calculated here because almost the same duty holds in the present printing. The window C has a size of 128 dots longitudinally by 128 dots horizontally (resolution in the horizontal direction is 1200 dots per inch, i.e., 1200 dpi) and is for calculating printing duty over the entire width of the printhead.

In the scanning of the window C, printing duty is calculated while the window C is shifted in increments of the window size (128 dots horizontally in this embodiment) in the direction of arrow D, i.e., in the scanning direction of the printhead in FIG. 5. In this embodiment, the window C is moved from left to right for the sake of convenience. The lower edge of the area A, which is a boundary area E with respect to the next printing area B, shall be referred to as a boundary portion. The printing area in area A from which the boundary portion has been excluded shall be referred to as a "central portion".

In this embodiment, an image is completed by scanning the same location twice. Therefore residual duty is calculated and printing direction is determined only with regard to the area that is on the leading half side of nozzle length, as set forth above in the foregoing embodiment.

If an area occupied by the window C in which the residual duty exceeds the threshold value is detected three times in succession in the boundary area E on the leading side of the printing medium, or if such an area is detected five times in succession in the central portion, then printing (unidirectional printing) is performed by a left-to-right scan or right-to-left scan in a manner similar to that of the first embodiment. Furthermore, if the residual duty has exceeded 15% in the boundary area E on the leading side, then three scans, inclusive of the scan that is to be printed now, are printed in the designated printing direction. The reason for this is that a boundary portion in which it is judged that color unevenness will readily occur is included in the scan area to be printed now and in the scan area that will be printed next, and scan areas in which printing is performed successively are adjacent to each other. In a case where the residual duty has exceeded 25% with regard to the image area in the central portion, two scans, inclusive of the scan that is to be printed now, are printed in the designated direction. In a case where such a prescribed group of areas in which the threshold value is exceeded successively in this manner does not exist at the edge portion on the leading side and over the entire image area, printing (back-and-forth printing) is performed using both the left-to-right and right-to-left scanning directions.

Figure 12:
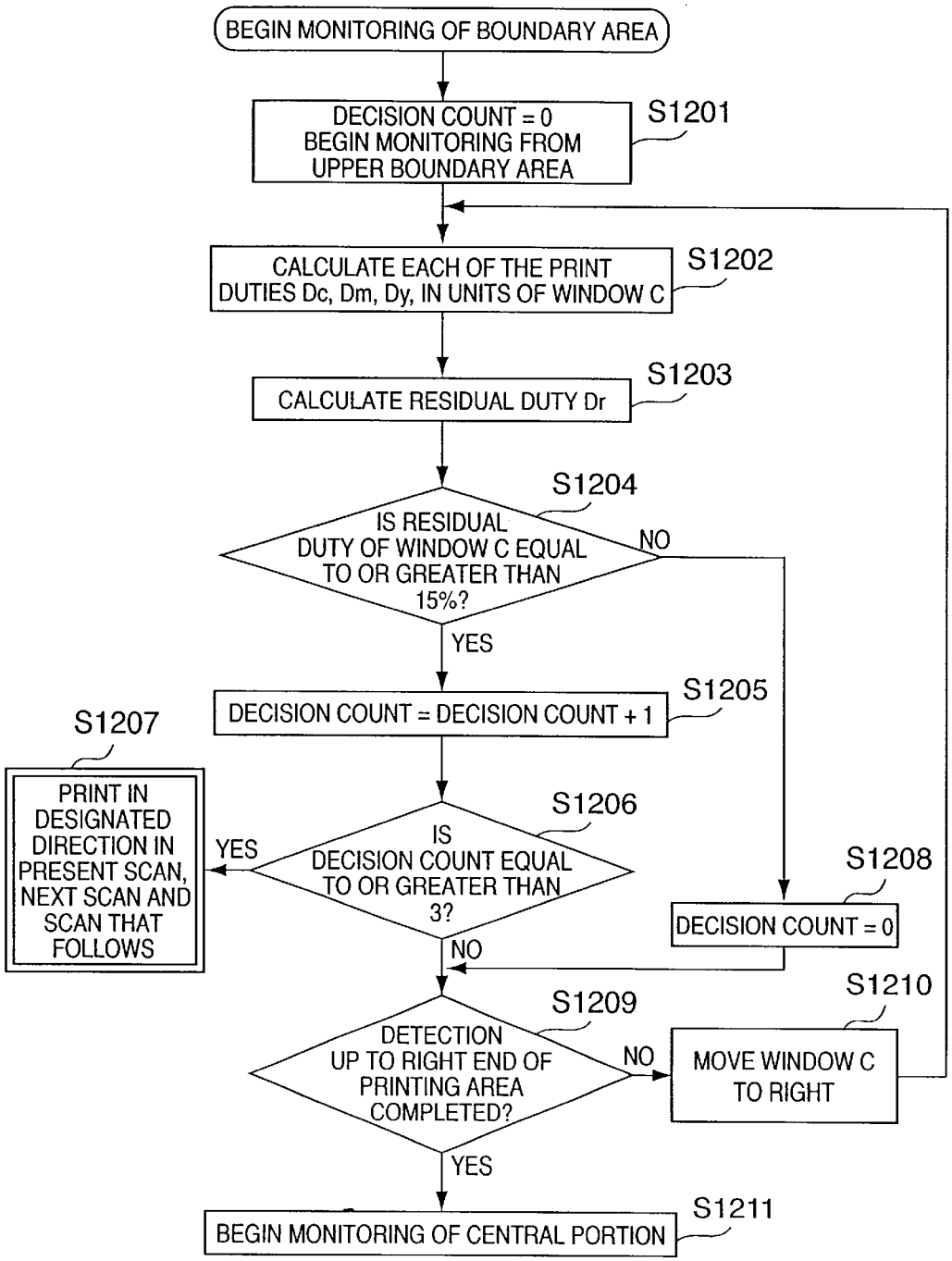
FIG. 12 is a flowchart useful in describing processing for deciding scanning direction in a second embodiment.

FIG. 12 is a flowchart illustrating the processing described above. First, at step S1201 in FIG. 12, a decision count is set to 0 as an initializing operation and the boundary area E of the image area that is to be printed now starts being monitored. That is, the window C is placed at the left end of the boundary area E. Next, at step S1202, the duties of the colors cyan, magenta and yellow are counted in the zone occupied by the window C. In the second embodiment, a weighting calculation is not performed with respect to the counting of duty. The residual duty Dr is calculated at step S1203 using the calculated duties. More specifically, the difference between the total (Dtotal) of the duties of the respective colors and the maximum value (Dmax) of duty is calculated.

Next, at step S1204, the residual duty Dr is evaluated. Here the lower threshold value of 15% is used because a boundary area is being monitored. It is determined whether the residual duty Dr is equal to or greater than the threshold value of 15%. If the residual duty Dr is less than 15% ("NO" at step S1204), the decision count is returned to 0 at step S1208 and control proceeds to step S1209.

If the residual duty Dr is equal to or greater than the threshold value of 15% ("YES" at step S1204), control proceeds to step S1205, where the decision count is incremented by 1. It is then determined at step S1206 whether the decision count is 3 or greater in order to judge whether the residual duty has exceeded 15% three or more times in succession. If it is found that the count is 3 or greater ("YES" at step S1206, then it is judged at this time that areas having a high residual duty exist contiguously in the boundary portion. Monitoring is therefore halted and printing in the designated direction is carried out at step S1207. If it is found that the count is 2 or less ("NO" at step S1206), control proceeds to step S1209. It should be noted that in a case where it is judged that color unevenness will occur in the area E of the boundary portion, i.e., in the case of step S1207, then the present scan, the next scan and the scan after the next scan are performed in the designated direction.

It is determined at step S1209 whether the evaluation window C has arrived at the right end of the image. If the window C has arrived at the right end ("YES" at step S1209), control proceeds to step S1211, where the monitoring of the central portion is started because monitoring of the boundary portion E is finished. If the window C has not arrived at the right end ("NO" at step S1209), the window C is moved rightward by an amount equivalent to the width of the window. Control then returns to step S1202.

By thus repeating the processing of steps S1202 to S1220, it is possible to monitor the boundary area E of the image that is to be printed now. If it is not found that the residual duty exceeds the threshold value three times in succession in the boundary area E, then monitoring of the central portion begins.

Figure 13:
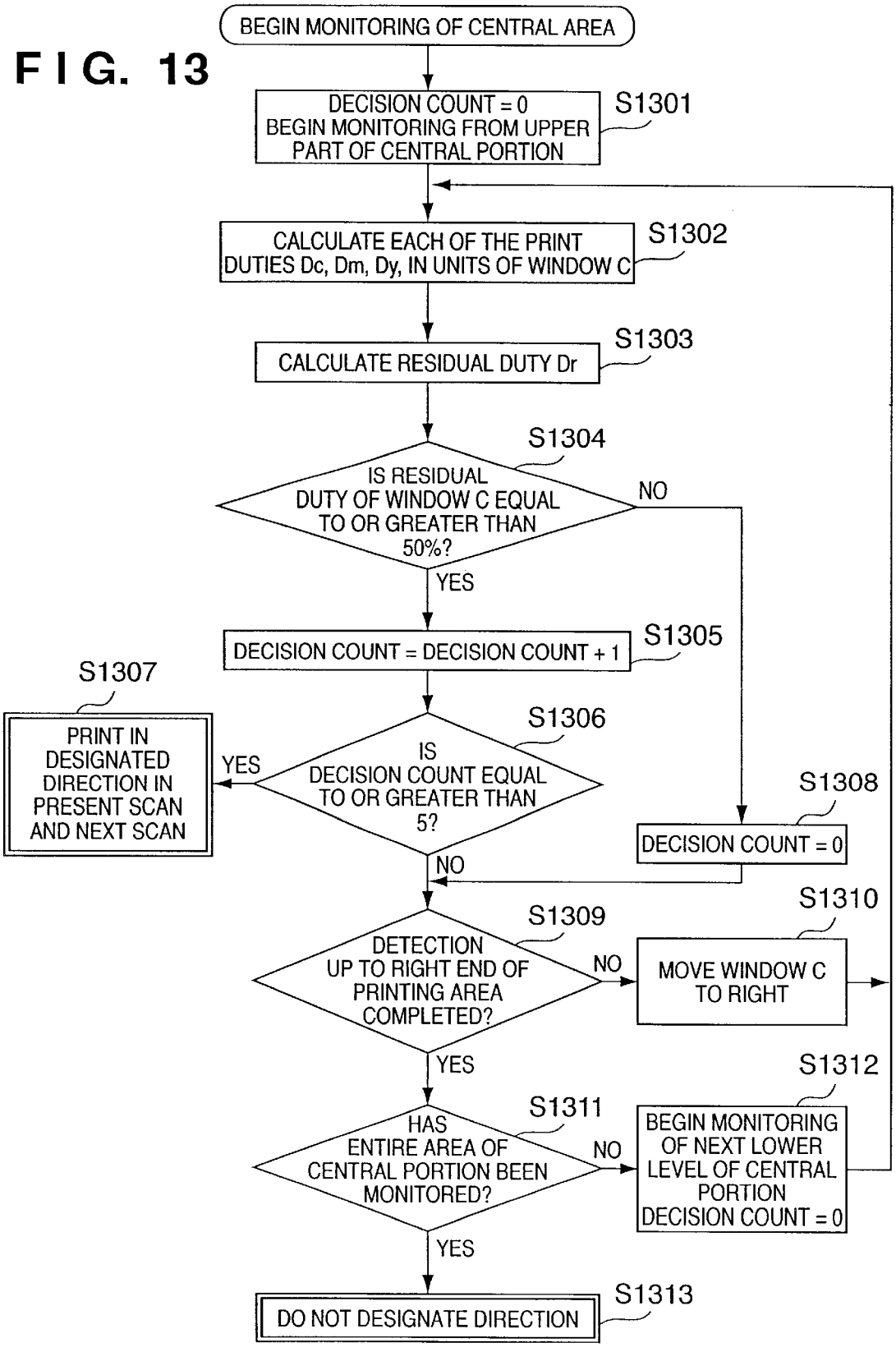
FIG. 13 is a flowchart useful in describing processing for deciding scanning direction in the second embodiment.

FIG. 13 is a flowchart for describing monitoring of the central portion of the image. The processing of steps S1301 to S1310 is similar to the processing of steps S1201 to S1210 described above. However, since the central portion does not contact the next area to be printed or the preceding printed area, a threshold value (50%) higher than that for monitoring of the boundary portion is used. If an area in which the residual duty is higher than the above-mentioned threshold value is found five times in succession in area of the central portion, control proceeds to step S1307 in order that printing in the designated direction will be carried out. In a case where it has been predicted that color unevenness will readily occur in the central portion, i.e., in the case of step S1307, the present scan and the next scan are made the designated direction.

When the window C arrives at the right end, it is determined at step S1311 whether monitoring of the entire area of the central portion has ended. If there is still an unscanned portion, the window C is set at the left end of the next lower level, the decision count is initialized to 0 and control returns to step S1302.

If an area in which the residual duty is higher than the above-mentioned threshold value is not detected five times in succession in the central portion, control proceeds to step S1313, where direction is not designated. In this case, printing in the designated direction is carried out with regard to the scan for which designated-direction printing was designated at step S1207 or step S1307. Further, if scanning direction was designated neither at step S1207 nor at step S1307, bidirectional printing is carried out.

In a case where the residual duty within the window C has exceeded 15% three times in succession in the boundary portion, three scans from this scan onward, inclusive of the scan that is to be printed now, are printed in the direction that has been decided. This is because there are three scans in which there is a possibility that color unevenness will occur between the scan and this boundary portion. Monitoring is performed also with regard to the next scan and the one that follows it, in which the printing direction has already been designated, and the number of scans for which direction is designated is successively updated.

Next, if residual duty exceeds 50% five times in succession in the central portion, printing is performed in the decided direction in two scans inclusive of the scan that is to be printed now. This is because there are two scans in which there is a possibility that color unevenness will occur between the scan and the central portion. Monitoring is performed also with regard to the next scan in which the printing direction has already been designated, and the number of scans for which direction is designated is successively updated.

<Other Embodiment>

In the first and second embodiments, the example described is one in which image data is present in the image area A and, as a result, the amount of feed of the printing paper is equivalent to the length of 1280 nozzles, which is the printing width of the printhead. However, when the printing duty of the entire area of image area A is 0%, i.e., when no image data is present, the printing paper may be transported an extra amount commensurate with this area.

Figure 14:
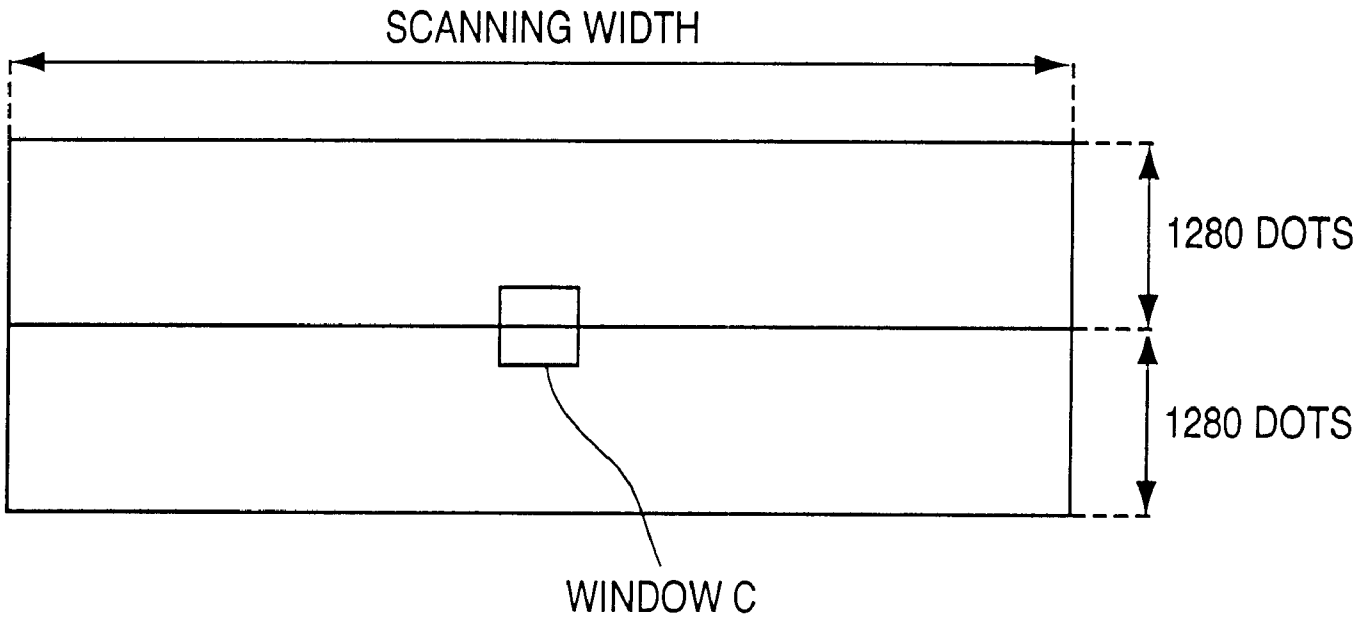
FIG. 14 is a diagram useful in describing another example of a window for calculating residual duty.
Figure 15:
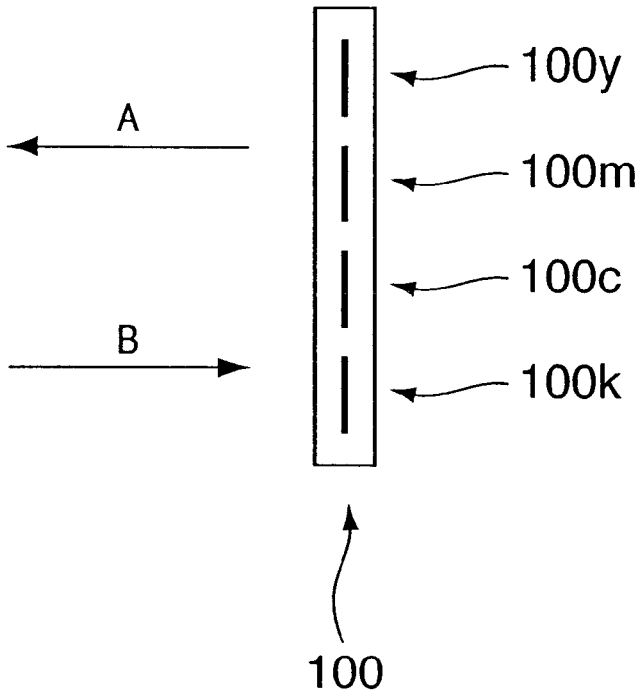
FIG. 15 is a diagram useful in describing the structure of an ordinary printhead.
Figure 16:
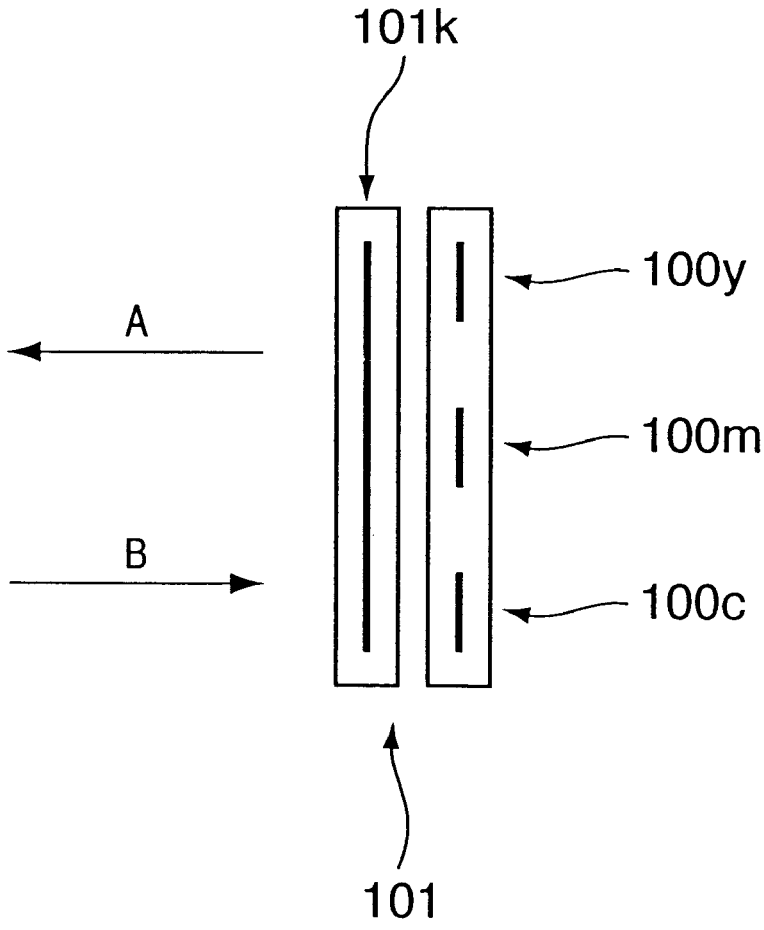
FIG. 16 is a diagram useful in describing the structure of an ordinary printhead.
Figure 17:
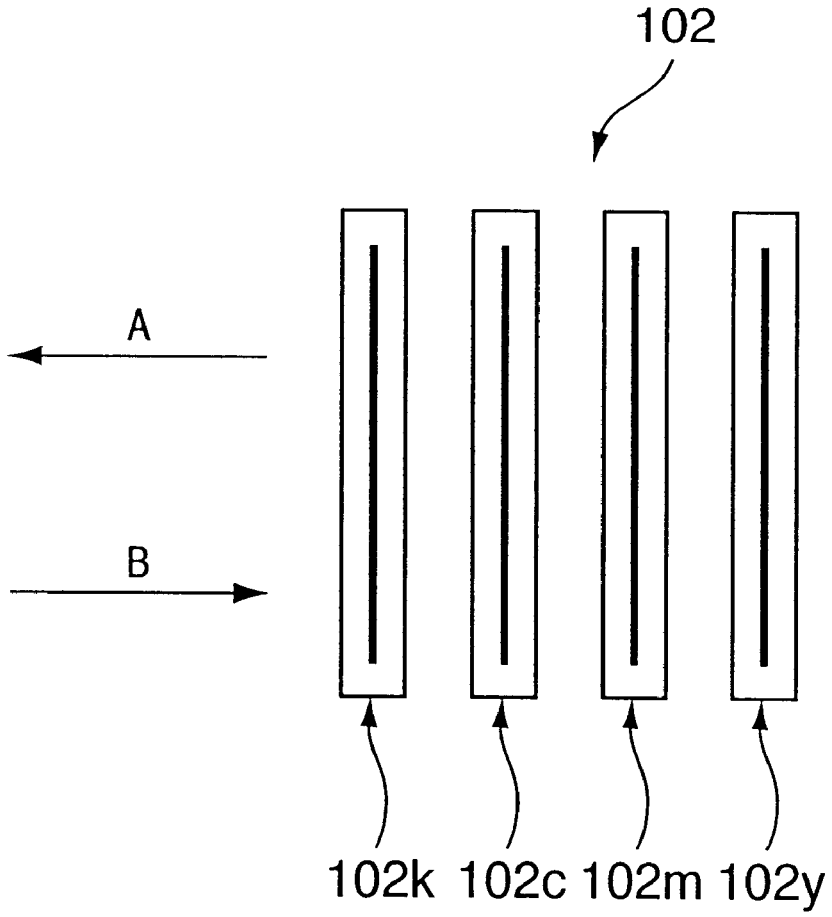
FIG. 17 is a diagram useful in describing the structure of an ordinary printhead.

Furthermore, the size of the window C is not limited to the size indicated in the first embodiment. Further, as shown in FIG. 14, the size of the window C may exceed the width to be scanned now and extend into the preceding scan or the next scan. In this case the occurrence of color unevenness at the boundary portion of the scans can be detected with greater precision.

Other Mode of Calculating Residual Duty

In the first and second embodiments, the residual duty is defined as a value obtained by subtracting the amount of applied ink for which the amount applied is large from the applied amount of all of the inks combined. This value is one suitable as an index for sensing color unevenness. With this method, however, if three types of inks are used, for example, a size evaluation is performed twice in order to obtain the maximum value, an addition operation is performed twice in order to find the overall amount of ink applied, and then finally a subtraction operation for finding the difference is performed, for a total of five arithmetic operations. Though this number of arithmetic operations does not pose a problem if the CPU processing speed is high, there are also occasions where processing cannot keep up because of, say, the number of areas in which calculation is to be performed. On such occasions there is the possibility that printing time will be prolonged.

In such case a method of directly incrementing a weighting duty count other than the maximum value is available. If cyan, for example, exhibits the maximum duty in such case, it will suffice to find the sum of magenta and yellow directly. In doing so the number of arithmetic operations will be two for the size evaluation, which is for finding the sequence of the duties, and one in order to sum the duties of yellow and magenta. Thus the total number of arithmetic operations is reduced to three.

Another method of simplification is to detect only the printing duty that is second from the largest. For example, assume a case where the printing duties are 100% for cyan, 50% for magenta and 30% for yellow. Though 80% is the residual duty, the 50% printing duty of magenta, which is the second largest, is adopted as the residual duty in abbreviated fashion. As a result, the number of arithmetic operations is reduced to two, which are solely for the size evaluation. Though the value found by this method cannot be said to be an ideal value of residual duty, the ideal residual duty is predicted to be less than twice the duty of magenta because the value of duty for yellow is the same as that for magenta even at maximum. This means that it is possible to deal with the above by lowering the threshold value. This method is highly effective as it makes it possible to reduce the number of calculations by a wide margin in a system in which the inks are of 6 to 12 colors. It goes without saying that in this case an application is possible in which not just a second color but a second color plus a third color are used.

Thus, in accordance with this embodiment as described above, in a printing apparatus wherein printheads that eject inks of a number of colors are arrayed in the scanning direction, printing direction is decided by calculating printing duty and residual duty from image data in a prescribed area. As a result, it is possible to perform high-speed printing by printing back-and-forth if it has been judged that color unevenness will not readily occur. Further, printing is performed unidirectionally if it has been judged that color unevenness will readily occur. This makes it possible to minimize a decline in printing speed.

In accordance with the present invention as described above, a decline in image quality caused by a difference in coloring sequence between back and forth scans is prevented, thereby making it possible to achieve high-quality printing of an image.

Further, in accordance with the present invention, a rise in printing speed is achieved while reducing color unevenness by solving both the problem of color unevenness due to a difference in color ejection sequence caused by performing back-and-forth scanning of a printhead, and the problem of a decline in printing speed caused by performing printing in one direction only.

As many apparently widely different embodiments of the present invention can be made without departing from the spirit and scope thereof, it is to be understood that the invention is not limited to the specific embodiments thereof except as defined in the appended claims.

What is claimed is:

1. An image forming apparatus for forming an image by repeatedly causing a printhead, which prints an image, to print on and scan a scan area using printing materials of a plurality of types, comprising:

acquisition means for quantifying the state of a mixture of the printing materials in printing of an image in the next scan area, thereby acquiring index information representing the state of the mixture;

decision means for deciding direction of a printing scan in said next scan area based upon the index information acquired by said acquisition means; and print execution means for executing a printing scan in said next scan area by performing a printing scan in the direction decided by said decision means.

2. The apparatus according to claim 1, wherein said acquisition means quantifies the state of the mixture based upon printing duty of each printing material in printing of the image in said next scan area.

3. The apparatus according to claim 2, wherein said acquisition means acquires residual duty as the index information, said residual duty being obtained based upon printing duties of the printing materials with the exception of whichever of the printing materials exhibits maximum printing duty in an area that is at least a portion of said next scan area.

4. The apparatus according to claim 3, wherein the residual duty is obtained by subtracting, from the sum total of printing duties of all types of the printing materials, the maximum value of printing duty of whichever of the printing materials exhibits the maximum value of printing duty in an area that is at least a portion of said next scan area.

5. The apparatus according to claim 3, wherein the residual duty is obtained by summing a predetermined number of total values in order of decreasing numerical value among total values from which the maximum value is excluded of the totals of printing duties of each of the printing materials in an area that is at least a portion of said next scan area.

6. The apparatus according to claim 3, wherein said decision means decides upon a predetermined direction as the direction of a printing scan in said next scan area if the residual duty is greater than a predetermined value.

7. The apparatus according to claim 6, wherein said decision means decides the direction of a printing scan in said next scan area giving priority to printing speed if the residual duty is less than or equal to the predetermined value.

8. The apparatus according to claim 6, wherein said decision means decides upon said predetermined direction as the scanning direction of a printing scan with regard to a prescribed number of scan areas inclusive of said next scan area if the residual duty is greater than the predetermined value.

9. The apparatus according to claim 3, wherein said acquisition means acquires the residual duty in each of small areas in said next scan area; and said decision means decides the scanning direction in said next scan area based upon the residual duty of each small area acquired by said acquisition means.

10. The apparatus according to claim 9, wherein said decision means decides upon a predetermined direction as the direction of a printing scan in said next scan area if small areas that have a residual duty greater than a predetermined threshold value exist contiguously in a number greater than a predetermined number.

11. The apparatus according to claim 10, wherein the scan area is divided into a plurality of portions and said predetermined value and said predetermined number are set to different values in each portion.

12. The apparatus according to claim 11, wherein the scan area is divided into a boundary portion that includes a portion adjacent to another scan area, and a central portion other than the boundary portion, and a predetermined value and/or predetermined number in the boundary portion are/is set to be smaller than a predetermined value and/or predetermined number in the central portion.

13. The apparatus according to claim 2, wherein said acquisition means applies weighting to printing duty of each of the plurality of types of printing materials.

14. The apparatus according to claim 13, wherein the printing materials of the plurality of types include black, cyan, magenta and yellow, and said acquisition means adopts 0 as a weighting coefficient for weighting the printing duty of black and adopts 1 as a weighting coefficient for weighting the printing duties of each of cyan, magenta and yellow.

15. The apparatus according to claim 1, wherein the printing materials of the plurality of types include black, cyan, magenta and yellow.

16. The apparatus according to claim 15, wherein the black printing material includes a pigment ingredient in a colorant.

17. The apparatus according to claim 1, wherein the printhead is an inkjet printhead for printing by ejecting ink.

18. The apparatus according to claim 17, wherein the inkjet printhead ejects ink by utilizing thermal energy, said inkjet printhead having a thermal energy transducer for generating thermal energy applied to the ink.

19. The apparatus according to claim 17, wherein the printhead causes ink to change state by the thermal energy applied by the thermal energy transducer, and ejects the ink from an orifice based upon the change in state of the ink.

20. An image forming method of forming an image by repeatedly causing a printhead, which prints an image, to print on and scan a scan area using printing materials of a plurality of types, comprising:

an acquisition step of quantifying the state of a mixture of the printing materials in printing of an image in the next scan area, thereby acquiring index information representing the state of the mixture;

a decision step of deciding direction of a printing scan in said next scan area based upon the index information acquired at said acquisition step; and a print execution step of executing a printing scan in said next scan area by performing a printing scan in the direction decided at said decision step.

21. The method according to claim 20, wherein said acquisition step quantifies the state of the mixture based upon printing duty of each printing material in printing of the image in said next scan area.

22. The method according to claim 21, wherein said acquisition step acquires residual duty as the index information, said residual duty being obtained based upon printing duties of the printing materials with the exception of whichever of the printing materials exhibits maximum printing duty in an area that is at least a portion of said next scan area.

23. The method according to claim 22, wherein the residual duty is obtained by subtracting, from the sum total of printing duties of all types of the printing materials, the maximum value of printing duty of whichever of the printing materials exhibits the maximum value of printing duty in an area that is at least a portion of said next scan area.

24. The method according to claim 22, wherein the residual duty is obtained by summing a predetermined number of total values in order of decreasing numerical value among total values from which the maximum value is excluded of the totals of printing duties of each of the printing materials in an area that is at least a portion of said next scan area.

25. The method according to claim 22, wherein said acquisition step applies weighting to printing duty of each of the plurality of types of printing materials.

26. The method according to claim 25, wherein the printing materials of the plurality of types include black, cyan, magenta and yellow, and said acquisition means adopts 0 as a weighting coefficient for weighting the printing duty of black and adopts 1 as a weighting coefficient for weighting the printing duties of each of cyan, magenta and yellow.

27. The method according to claim 22, wherein said decision step decides upon a predetermined direction as the direction of a printing scan in said next scan area if the residual duty is greater than a predetermined value.

28. The method according to claim 27, wherein said decision step decides the direction of a printing scan in said next scan area giving priority to printing speed if the residual duty is less than or equal to the predetermined value.

29. The method according to claim 22, wherein said decision step decides upon said predetermined direction as the scanning direction of a printing scan with regard to a prescribed number of scan areas inclusive of said next scan area if the residual duty is greater than the predetermined value.

30. The method according to claim 22, wherein said acquisition step acquires the residual duty in each of small areas in said next scan area; and said decision step decides the scanning direction in said next scan area based upon the residual duty of each small area acquired by said acquisition step.

31. The method according to claim 30, wherein said decision step decides upon a predetermined direction as the direction of a printing scan in said next scan area if small areas that have a residual duty greater than a predetermined threshold value exist contiguously in a number greater than a predetermined number.

32. The method according to claim 31, wherein the scan area is divided into a plurality of portions and said predetermined value and said predetermined number are set to different values in each portion.

33. The method according to claim 32, wherein the scan area is divided into a boundary portion that includes a portion adjacent to another scan area, and a central portion other than the boundary portion, and a predetermined value and/or predetermined number in the boundary portion are/is set to be smaller than a predetermined value and/or predetermined number in the central portion.

34. The method according to claim 20, wherein the printing materials of the plurality of types include black, cyan, magenta and yellow.

35. The method according to claim 34, wherein the black printing material includes a pigment ingredient in a colorant.

* * * * *

UNITED STATES PATENT AND TRADEMARK OFFICE

CERTIFICATE OF CORRECTION

PATENT NO. : 6,517,192 B2 
DATED : February 11, 2003
INVENTOR(S) : Takumi Kaneko et al.

It is certified that error appears in the above-identified patent and that said Letters Patent is hereby corrected as shown below:

Title page,
Item [56], U.S. PATENT DOCUMENTS, "Kanada et al." should read -- Kanda et al. --.

Column 2,
Line 35, "In-the" should read -- In the --; and
Line 40, "&U" should be deleted.

Column 8,
Line 41, "a" should read -- an --.

Column 14,
Line 61, "printing-area" should read -- printing area --.

Signed and Sealed this

Twenty-eighth Day of October, 2003

JAMES E. ROGAN
*Director of the United States Patent and Trademark Office*